US008482490B2

(12) United States Patent
Murata et al.

(10) Patent No.: US 8,482,490 B2
(45) **Date of Patent: *Jul. 9, 2013**

(54) PLASMA DISPLAY DEVICE HAVING A PROTECTIVE LAYER INCLUDING A BASE PROTECTIVE LAYER AND A PARTICLE LAYER

(75) Inventors: Mitsuhiro Murata, Hyogo (JP); Kaname Mizokami, Kyoto (JP); Toshikazu Wakabayashi, Osaka (JP); Shinichiro Hashimoto, Osaka (JP); Keiji Akamatsu, Osaka (JP)

(73) Assignee: Panasonic Corporation, Osaka (JP)

( * ) Notice: Subject to any disclaimer, the term of this patent is extended or adjusted under 35 U.S.C. 154(b) by 380 days.

This patent is subject to a terminal disclaimer.

(21) Appl. No.: 12/596,774

(22) PCT Filed: Mar. 27, 2009

(86) PCT No.: PCT/JP2009/001396

§ 371 (c)(1),
(2), (4) Date: Oct. 20, 2009

(87) PCT Pub. No.: WO2009/122688

PCT Pub. Date: Oct. 8, 2009

(65) Prior Publication Data

US 2011/0001425 A1 Jan. 6, 2011

(30) Foreign Application Priority Data

Apr. 1, 2008 (JP) ..... 2008-094661

(51) Int. Cl.
*G09G 3/28* (2013.01)
*H01J 17/49* (2012.01)

(52) U.S. Cl.
USPC ..... 345/71; 313/587

(58) Field of Classification Search
USPC ..... 345/60–72; 315/169.4; 313/581–587
See application file for complete search history.

(56) References Cited

U.S. PATENT DOCUMENTS 6,292,159 B1 9/2001 Someya et al.
6,294,875 B1 9/2001 Kurata et al.

(Continued)

FOREIGN PATENT DOCUMENTS

EP 1 182 634 2/2002
EP 1 684 325 7/2006

(Continued)

OTHER PUBLICATIONS

International Search Report issued May 12, 2009 in International (PCT) Application No. PCT/JP2009/001396.

(Continued)

*Primary Examiner* — Chanh Nguyen
*Assistant Examiner* — Navin Lingaraju
(74) *Attorney, Agent, or Firm* — Wenderoth, Lind & Ponack, L.L.P.

(57) ABSTRACT

In a plasma display device, a plurality of agglomerated particle groups in which a plurality of crystal particles made of a metal oxide agglomerate are disposed in the periphery of a protective layer thereof. The plasma display device is driven by the following driving method to display images. An initializing period has a first half of the initializing period in which a second electrode is applied with a voltage gradually rising from a first voltage to a second voltage, and a second half of the initializing period in which the second electrode is applied with a voltage gradually falling from a third voltage to a fourth voltage.

12 Claims, 22 Drawing Sheets

U.S. PATENT DOCUMENTS

| | | | | |
|---|---|---|---|---|
| 6,753,649 | B1 | 6/2004 | Bechtel et al. | |
| 6,940,475 | B2 | 9/2005 | Shiizaki et al. | |
| 7,068,244 | B2 | 6/2006 | Nagao et al. | |
| 7,145,582 | B2 | 12/2006 | Shindo et al. | |
| 7,468,713 | B2 | 12/2008 | Ogawa et al. | |
| 7,723,919 | B2 | 5/2010 | Saitoh et al. | |
| 8,362,979 | B2 * | 1/2013 | Murata et al. | 345/71 |
| 2002/0075206 | A1 | 6/2002 | Takeda et al. | |
| 2003/0201953 | A1 | 10/2003 | Shiizaki et al. | |
| 2004/0085262 | A1 * | 5/2004 | Lee | 345/41 |
| 2004/0095295 | A1 | 5/2004 | Nagao et al. | |
| 2004/0196216 | A1 | 10/2004 | Shindo et al. | |
| 2005/0162348 | A1 | 7/2005 | Ogawa et al. | |
| 2005/0206318 | A1 * | 9/2005 | Hirota et al. | 313/585 |
| 2006/0152448 | A1 * | 7/2006 | Hatanaka et al. | 345/68 |
| 2006/0175976 | A1 | 8/2006 | Nishimura et al. | |
| 2006/0244685 | A1 * | 11/2006 | Kim et al. | 345/67 |
| 2007/0216603 | A1 * | 9/2007 | Kong et al. | 345/60 |
| 2007/0222385 | A1 * | 9/2007 | Kim et al. | 313/582 |
| 2007/0241995 | A1 * | 10/2007 | Itakura | 345/60 |
| 2007/0279331 | A1 * | 12/2007 | Nagao et al. | 345/67 |
| 2008/0061692 | A1 * | 3/2008 | Miura et al. | 313/582 |
| 2008/0157672 | A1 * | 7/2008 | Tsujita et al. | 313/586 |
| 2008/0290800 | A1 | 11/2008 | Saitoh et al. | |
| 2009/0140652 | A1 | 6/2009 | Fukui et al. | |
| 2009/0146566 | A1 | 6/2009 | Fukui et al. | |
| 2009/0256478 | A1 * | 10/2009 | Kawasaki et al. | 313/582 |
| 2010/0308710 | A1 * | 12/2010 | Chu et al. | 313/489 |

FOREIGN PATENT DOCUMENTS

| | | |
|---|---|---|
| EP | 1 717 786 | 11/2006 |
| EP | 2 031 629 | 3/2009 |
| JP | 7-296718 | 11/1995 |
| JP | 07-296718 | 11/1995 |
| JP | 2000-214823 | 8/2000 |
| JP | 2001-093424 | 4/2001 |
| JP | 2001-118511 | 4/2001 |
| JP | 2003-050563 | 2/2003 |
| JP | 2004-004513 | 1/2004 |
| JP | 2004-206094 | 7/2004 |
| JP | 2006-244784 | 9/2006 |
| JP | 2007-035655 | 2/2007 |
| JP | 2007-225778 | 9/2007 |
| JP | 2007-311075 | 11/2007 |
| JP | 2008-21660 | 1/2008 |
| JP | 2008-021660 | 1/2008 |
| JP | 2008-293772 | 12/2008 |
| JP | 2008-293803 | 12/2008 |
| WO | 02/33690 | 4/2002 |
| WO | 2007/139183 | 12/2007 |

OTHER PUBLICATIONS

Supplementary European Search Report issued Mar. 18, 2011 in Application No. EP 09 72 7522.

Ki-Duck Cho et al., "Bipolar Scan Waveform for Fast Address in AC Plasma Display Panel", IEICE Transactions on Electronics, Electronics Society, Tokyo, Japan, vol. E87-C, No. 1, Jan. 1, 2004, pp. 116-119.

* cited by examiner

PLASMA DISPLAY DEVICE HAVING A PROTECTIVE LAYER INCLUDING A BASE PROTECTIVE LAYER AND A PARTICLE LAYER

This application is a U.S. National Stage Application of PCT International Application PCT/JP2009/001396.

TECHNICAL FIELD

The present invention relates to a plasma display device used for displaying images on a computer or television.

BACKGROUND ART

In recent years, a plasma display panel (hereinafter referred to as a PDP) used for displaying images on a computer or television (TV) has been increasingly required to have not only a larger screen size, smaller thickness, and lighter weight, but also higher definition in order to achieve higher image quality.

A conventional PDP has a typical structure as shown in FIG. 26. With reference to FIG. 26, PDP 1100 is composed of front panel PA1001 and rear panel PA2.

Front panel PA1001 is composed of the following laminated layers: second electrodes, i.e. scan electrodes 19*a*, first electrodes, i.e. sustain electrodes 19*b*, and black stripes (a light-blocking layer) disposed in a stripe pattern on front glass substrate 11; dielectric layer 17; and protective layer 1018. Dielectric layer 17 is composed of first dielectric layer 17*a* and second dielectric layer 17*b*. First dielectric layer 17*a* is formed to cover scan electrodes 19*a*, sustain electrodes 19*b*, and black stripes 7. Protective layer 1018 is formed on dielectric layer 17. Each scan electrode 19*a* is made of scan transparent electrode 19*a*1 and scan metal electrode 19*a*2. Each sustain electrode 19*b* is made of sustain transparent electrode 19*b*1 and sustain metal electrode 19*b*2.

Rear panel PA2 is composed of the following elements: third electrodes, i.e. address electrodes 14; dielectric layer 13; and barrier ribs 15. The third electrodes, i.e. address electrodes 14, are disposed on rear glass substrate 12 in a stripe pattern. Dielectric layer 13 is formed to cover address electrodes 14. Barrier ribs 15 are formed on dielectric layer 13 in a box shape so as to cover address electrodes 14. Phosphor layers 16 are applied to the inner walls of barrier ribs 15. As the phosphor layers, generally, phosphors in three colors of red, green, and blue are arranged in this order for color display.

Front panel PA 1001 and rear panel PA2 are bonded to each other, and a discharge gas is sealed into discharge part 20 partitioned by barrier ribs 15. For example, a mixed gas composed of helium, neon, argon, krypton, xenon and the like is sealed typically at a pressure of approximately 67 kPa.

Next, a description is provided of an electrode array of the PDP, and a plasma display device that has a driving circuit for driving the PDP. FIG. 27 shows an electrode array of PDP 1100. FIG. 28 is a block diagram showing a structure of circuits for driving the plasma display device. This plasma display device has pane 11001, scan electrode driving circuit 1021, sustain electrode driving circuit 22, address electrode driving circuit 23, timing generating circuit 1024, analog-to-digital (A/D) converter 25, number of scan lines converter 26, subfield converter 27, and averaged picture level (APL) detector 28.

With reference to FIG. 28, image signal VD is input to A/D converter 25. Horizontal synchronizing signal H and vertical synchronizing signal V are input to timing generating circuit 1024, A/D converter 25, and number of scan lines converter 26. A/D converter 25 converts image signal VD into image data of digital signals, and outputs the image data to number of scan lines converter 26 and APL detector 28. APL detector 28 detects the averaged picture level of the image data. According to the averaged picture level detected, driving waveforms forming one TV field are controlled. Number of scan lines converter 26 converts the image data into image data corresponding to the number of pixels of PDP 1100, and outputs the converted data to subfield converter 27. The subfield will be described later. Subfield converter 27 outputs the image data divided into subfields to address electrode driving circuit 23. Address electrode driving circuit 23 applies voltages corresponding to address electrode D1 through address electrode Dm to the address electrodes for each of the subfield.

Timing generating circuit 1024 generates timing signals based on horizontal synchronizing signal H and vertical synchronizing signal V, and outputs the timing signals to scan electrode driving circuit 1021 and sustain electrode driving circuit 22. Scan electrode driving circuit 1021 and sustain electrode driving circuit 22 apply driving voltages to scan electrode SCN1 through scan electrode SCNn, and sustain electrode SUS1 through sustain electrode SUSn, respectively, according to the timing signals.

Next, a description is provided of gradation representation method used in PDP 1100. FIG. 29 shows a gradation representation method used in PDP 1100. When a TV image is displayed, an image compliant with National Television System Committee (NTSC) system, for example, is formed of 60 fields per second. Originally, PDP 1100 is capable of representing only two levels of gradation, i.e. light emission and non-light emission. Thus neutral colors are represented in the following manner. One field period is divided into a plurality of subfields (hereinafter, SFs). The periods for emitting red, green, and blue light are time-divided and combined. For example, the numbers of sustain pulses applied in the discharge sustain periods of the respective SFs are weighted to have ratios in a binary mode, such as 1, 2, 4, 8, 16, 32, 64, and 128. SFs of the 8-bit combination can provide 256 levels of gradation representation.

In this method, each SF is further divided into four periods so that the gas discharge in discharge part 20 is controlled. FIG. 30 shows voltage waveforms applied to scan electrodes SCN, sustain electrodes SUS, and address electrodes D in one SF for driving the plasma display device. These four periods will be described with reference to FIG. 26, FIG. 27, and FIG. 30.

In an initializing period, prior to address period 1032 in which an address discharge for selecting cells to be lit is performed, wall charges desired for the address discharge are accumulated by a weak discharge. In the first SF in one TV field, all-cell initializing period 1031 is set. In this all-cell initializing period, an all-cell initializing operation for causing an initializing discharge in all the cells used for displaying an image is performed. In the other SFs, selective initializing periods 1034 are set. In this selective initializing period, the all-cell initializing operation or a selective initializing operation is performed. In the selective initializing operation, the initializing discharge is caused only in the cells having undergone a sustain discharge in the preceding SF. In address period 1032, cells to be lit by an address discharge are selected. In sustain period 1033, a sustain operation for sustaining light emission in the cells having undergone the address discharge in address period 1032 is performed.

In the initializing operation in the first half of all-cell initializing period 1031, all the sustain electrodes, i.e. sustain electrode SUS1 through sustain electrode SUSn, and all the address electrodes, i.e. address electrode D1 through address electrode Dm, are kept at 0 V. To all the scan electrodes, i.e. scan electrode SCN1 through SCNn, a ramp voltage gradually rising toward voltage Vh is applied. Here, voltage Vh is equal to or higher than threshold voltage Vff at which a discharge starts between the scan electrodes and sustain electrode SUS1 through sustain electrode SUSn in pairs with the scan electrodes, and between the scan electrodes and address electrode D1 through address electrode Dm faced to the scan electrodes. Thus a gas discharge occurs in discharge part 20. This discharge is a weak discharge in which electrolytic dissociation temporally gradually proceeds. The electric charges generated by this weak discharge are accumulated on the wall surfaces surrounding discharge part 20 so as to reduce the electric field of the inside and surfaces of discharge part 20 in the periphery of address electrodes 14, scan electrodes 19*a*, and sustain electrodes 19*b*. A negative charge is accumulated on the surface of protective layer 18 in the vicinity of scan electrodes 19*a*. A positive charge is accumulated on the surface of protective layer 18 in the vicinity of sustain electrodes 19*b* and the surface of phosphor layers 16 in the vicinity of address electrodes 14.

Further, in the initializing operation of the second half of all-cell initializing period 1031, all the sustain electrodes, i.e. sustain electrode SUS1 through sustain electrode SUSn, are kept at positive voltage Ve. To all the scan electrodes, i.e. scan electrode SCN1 through SCNn, a ramp voltage gradually falling toward voltage Vbt is applied. Here, voltage Vbt is equal to or lower than threshold voltage Vpf at which a discharge starts between the scan electrodes and sustain electrode SUS1 through sustain electrode SUSn in pairs with the scan electrodes, and between the scan electrodes and address electrode D1 through address electrode Dm faced to the scan electrodes. Thus a gas discharge occurs in discharge part 20. This discharge is also a weak discharge in which electrolytic dissociation temporally gradually proceeds. This weak discharge reduces the negative charge accumulated on the surface of protective layer 18 in the vicinity of scan electrodes 19*a* and the positive wall charge accumulated on the surface of protective layer 18 in the vicinity of sustain electrodes 19*b*.

In a state where all the electrodes are grounded after completion of the all-cell initializing operation, a potential difference (hereinafter referred to as a wall potential) necessary for selecting cells to be lit by the address discharge is generated by the accumulated wall charges, between the scan electrodes and address electrodes 14 and between the scan electrodes and sustain electrodes 19*b*. The initializing operation is an operation in which a discharge forms wall charges desired for controlling the address discharge.

In address period 1032, scan electrodes 19*a* are applied with a voltage lower than those applied to address electrodes 14 and sustain electrodes 19*b*. Further, only address electrodes 14 in the cells to be lit are applied with a voltage so that a voltage difference of the same polarity as the wall potential is generated between scan electrodes 19*a* and address electrodes 14. This voltage application causes an address discharge. Thus, as a wall charge, a negative charge is accumulated on the surface of the phosphors and the surface of the protective layer in the vicinity of sustain electrodes 19*b*. A positive charge is accumulated on the surface of the protective layer in the vicinity of scan electrodes 19*a*. In a state where the address period is completed and all the electrodes are grounded, a desired wall potential at which the wall charges cause a sustain discharge between scan electrodes 19*a* and sustain electrodes 19*b* is generated.

In sustain period 1033, first, scan electrodes 19*a* are applied with a voltage higher than the voltage applied to sustain electrodes 19*b*, and thus a discharge occurs between the electrodes. Thereafter, the voltage is applied to scan electrodes 19*a* and sustain electrodes 19*b* so that the polarity is alternately changed. Thus the light emission is intermittently sustained.

In subsequent selective initializing period 1034, at the end of sustain period 1033 of the preceding SF, sustain electrodes 19*b* are applied with an erasing voltage in a rectangular waveform so that a short time difference is provided from the voltage application to scan electrodes 19*a*. Such voltage application causes an incomplete discharge and erases a part of the wall charges, which are preparations for the initializing operation in the subsequent SF. In this manner, in the conventional method for driving a PDP, images are displayed in a sequence of the initial period, address period, and sustain period. The all-cell initializing operation is performed not only in the first SF of one field, and can be performed in other SFs.

For PDP 1100 of FIG. 26, in all-cell initializing period 1031 in which desired wall charges are accumulated by a weak discharge, the density of ions or electrons (charged particles, i.e. a source of electrolytic dissociation) present in discharge part 20 at the initial stage thereof is low, or the phosphors or barrier ribs likely to absorb the electric charges of charged particles surround discharge part 20. In such cases, the number of the charged particles, i.e. a source of discharge, is absolutely decreased. This state increases the probability of occurrence of strong discharge in which electrolytic dissociation temporally rapidly proceeds (hereinafter, referred to as a strong discharge).

When a strong discharge occurs, wall charges (e.g. wall charges substantially canceling out the electric field of discharge part 20) more than the desired wall charges are accumulated, and thus an abnormal wall potential higher than the desired wall potential is generated.

The action of this abnormal wall potential causes sustain light emission in the cells to be unlit in the sustain periods, and images cannot be displayed normally (see Patent Document 1, for example).

Further, image display using a high-definition PDP has the following problems. For example, in a high-definition PDP, even when the cells are isolated by barrier ribs, a fine cell pitch (intervals between barrier ribs) increases the influences of the electric field interference between the adjacent cells and scattering charged particles.

In the conventional method for driving a PDP as shown in FIG. 30, application of a rectangular waveform voltage in selective initializing period 1034 causes a strong erasing discharge. Thus, when a high-definition PDP is driven, the influence of discharge interference between the adjacent cells in the initializing operation is conspicuous. Therefore, wall potential desired for the address operation cannot be accumulated, and the address operation cannot be performed normally (see Patent Document 2, for example).

In the conventional PDP, the amount of electrons to be supplied for causing a stable initializing operation is insufficient in the following two cases, for example. The pixel pitch is reduced for higher definition, and thus in discharge part 20, the rate of the surface area to the volume is increased. For a higher luminance, the mixing ratio of a gas having a larger atomic number, e.g. xenon and krypton, in the discharge gas is increased. In such cases, a strong discharge occurs in the initializing periods. The abnormal wall charges accumulated by the strong discharge cause sustain light emission in the cells to be unlit in the sustain periods. As a result, images cannot be displayed normally.

Further, when a high-definition PDP is driven by the conventional driving method, the influences of the electric field interference between the adjacent cells and scattering charged particles are conspicuous in a selective initializing period. Thus, no sustain light emission is caused in the cells to be lit in the sustain periods, and images cannot be displayed normally.

The reasons why these problems become more conspicuous as the definition is increased will be detailed hereinafter.

As the definition is increased, the volume of each cell in discharge part 20 is decreased. Thus the rate of the surface area of the wall surface to the volume of discharge part 20 is increased. This structure increases the energy loss caused by heat generation resulting from the re-absorption and elastic collision of the charged particles on the wall surfaces. The energy loss necessitates introduction of more electric power externally. As a result, the number of charged particles inside discharge part 20 before the all-cell initializing operation is decreased, and the driving voltage in each period is increased.

When an increased voltage is applied to electrodes, the field intensity increases in the inside and surfaces of discharge part 20 in the periphery of the electrodes. Thus the probability that electrolytic dissociation temporally rapidly proceeds is increased. As a result, it becomes more difficult to generate a weak discharge used for the conventional initializing operation.

In this manner, with an increase in definition, the charged particles inside of discharge part 20 are decreased and the driving voltages are increased. Thus a strong discharge is more likely to occur in the initializing periods. As a result, it becomes more difficult to normally select the cells to be lit or the cells to be unlit in the address periods.

Further, with an increase in definition, the size of each cell is reduced. This size reduction increases the light-blocking rate determined by the barrier ribs and metal electrodes, and decreases the luminance. Thus the images become darker in general. To address this problem, as a method for ensuring a luminance necessary for displaying a high-quality image, a method for increasing the mixing ratio of xenon or krypton causing emission of visible light, or the total pressure of a discharge gas is drawing attention. For example, total pressures from 180 Torr to 750 Torr inclusive, and xenon partial pressures of 10%, 15%, 20%, 30%, 50%, 80%, 90%, 95%, 98%, and 100% are considered.

The reason why the above problems are conspicuous at a larger mixing ratio of xenon, krypton, or the like will be detailed hereinafter.

In an element having a larger atomic number, such as xenon and krypton, the electron energy (first ionization energy) in the outermost shell is small. Thus the secondary electron emission coefficient of such an element is extremely smaller than those of helium, neon, and argon that have larger electron energies in the outermost shells. As a result, the absolute number of electrons supplied from the surface of the protective layer to discharge part 20 is small, and the threshold voltage necessary for starting discharge is high.

When an increased voltage is applied to electrodes, the field intensity increases in the inside and surfaces of discharge part 20 in the periphery of the electrodes. This phenomenon increases the probability that electrolytic dissociation temporally rapidly proceeds. As a result, it becomes more difficult to generate the weak discharge used in the initializing period.

When the partial pressure of xenon or krypton is increased to ensure a high luminance necessary for displaying high-quality images, a strong discharge is likely to occur in the all-cell initializing operation. When a strong discharge occurs, one discharge provides high emission intensity. Thus the contrast ratio is considerably decreased, and the image quality is considerably degraded when images having many low gradation representations are displayed. Further, formation of excessive wall potential makes it more difficult to select the cells to be lit or the cells to be unlit in the address periods.

[Patent Document 1] Japanese Patent Unexamined Publication No. 2000-214823

[Patent Document 2] Japanese Patent Unexamined Publication No. 2006-151295

SUMMARY OF THE INVENTION

A plasma display device includes a plasma display panel. The plasma display panel includes the following elements:

a first substrate including the following elements:

at least one pair of a first electrode and a second electrode;

a dielectric layer formed so as to cover the first electrode and the second electrode; and a protective layer formed on the surface of the dielectric layer; and a second substrate including the following elements:

at least one of a third electrode; and a dielectric layer formed so as to cover the third electrode.

The first substrate and the second substrate are faced to each other. A discharge gas is sealed between the first substrate and the second substrate. The protective layer is formed by attaching a plurality of agglomerated particle groups, in which a plurality of crystal particles made of a metal oxide agglomerate, to a base protective layer. One field is formed of a plurality of subfields. Each subfield has at least an initializing period and an address period, in the initializing period, the address period, and a sustain period. The initializing period has a first half of the initializing period in which the second electrode is applied with a voltage gradually rising from a first voltage to a second voltage, and a second half of the initializing period in which the second electrode is applied with a voltage gradually falling from a third voltage to a fourth voltage.

REFERENCE MARKS IN THE DRAWINGS

Figure 1:
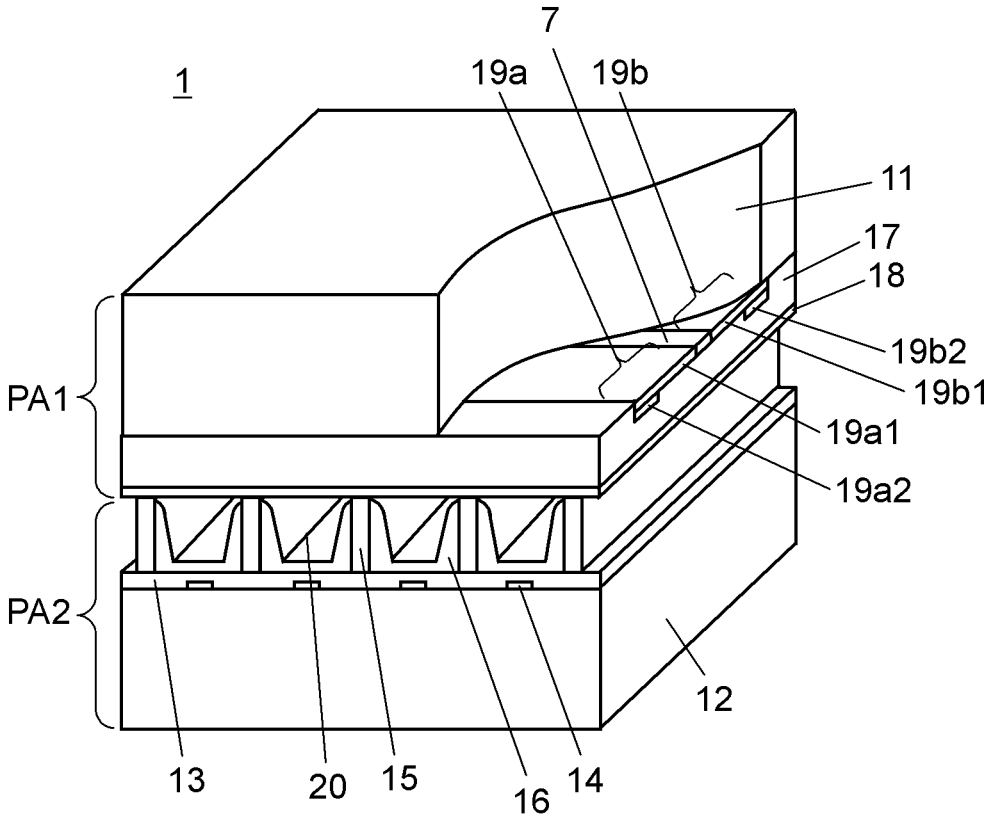
FIG. 1 is a perspective view showing an essential part of a panel for use in an exemplary embodiment of the present invention.

1 Plasma display panel
11 Front glass substrate
12 Rear glass substrate
13 Dielectric layer
14 Address electrode
15 Barrier rib
16 Phosphor layer
17 Dielectric layer
17*a* First dielectric layer
17*b* Second dielectric layer
18 Protective layer
18*a* Base protective layer
18*b* Crystal particle
18*c* Agglomerated particle group
19*a*1 Scan transparent electrode
19*a*2 Scan metal electrode
19*b*1 Sustain transparent electrode
19*b*2 Sustain metal electrode
20 Discharge part
21 Scan electrode driving circuit
22 Sustain electrode driving circuit
23 Address electrode driving circuit
24 Timing generating circuit
25 Analog-to-digital (A/D) converter
26 Number of scan lines converter
27 Subfield converter
28 Averaged picture level (APL) detector
31 All-cell initializing period
32 Address period
33 Sustain period
34 Selective initializing period
35 Initializing period

DETAILED DESCRIPTION OF PREFERRED EMBODIMENT

Figure 2:
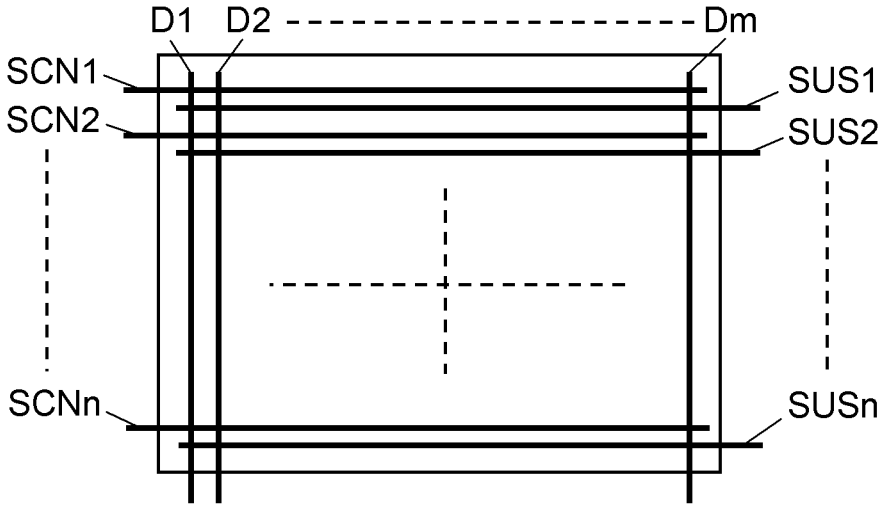
FIG. 2 is an electrode array diagram of the panel in accordance with the exemplary embodiment of the present invention.
Figure 3:
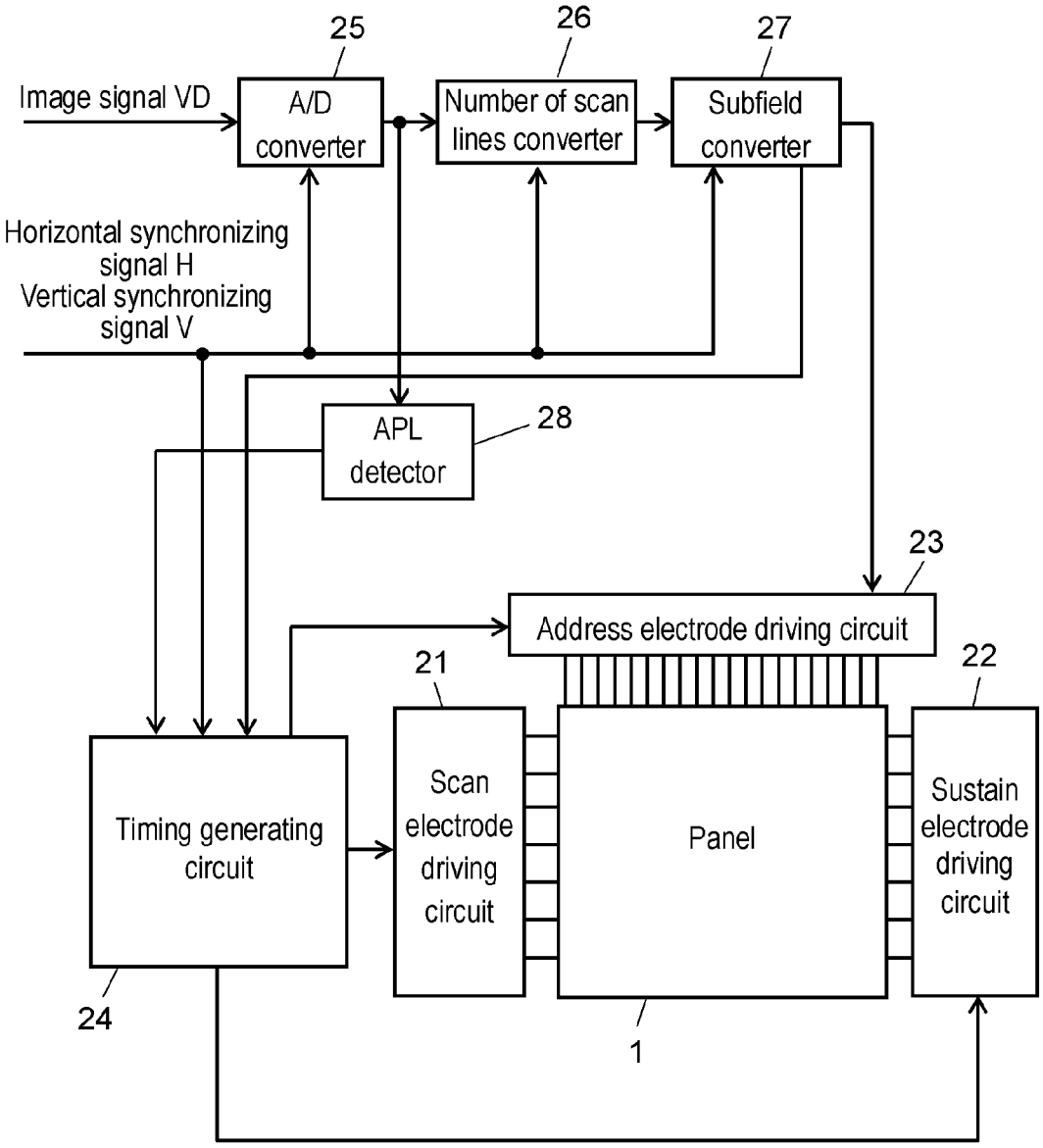
FIG. 3 is a block diagram of a plasma display device including the plasma display panel (PDP) in accordance with the exemplary embodiment.
Figure 4:
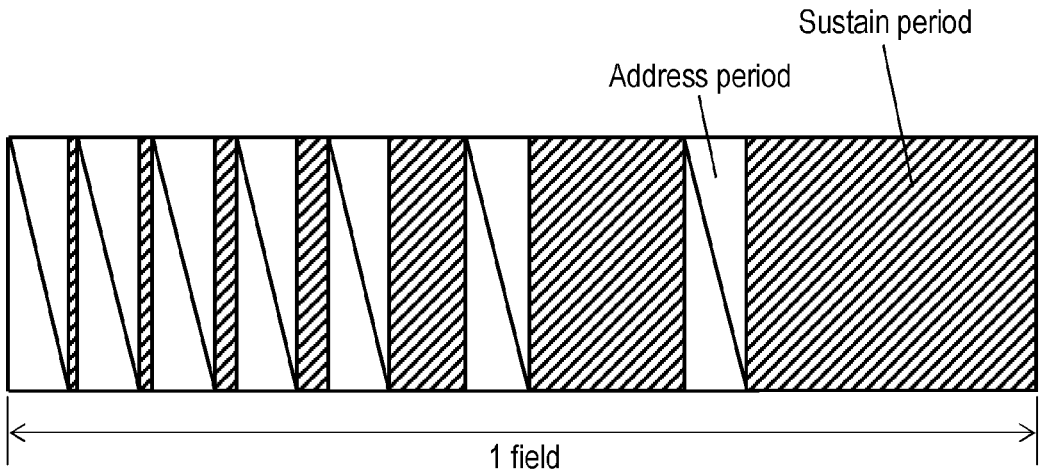
FIG. 4 is a structural diagram of a subfield in a method of driving the PDP in accordance with the exemplary embodiment.

Hereinafter, an exemplary embodiment of the present invention is described with reference to the accompanying drawings. FIG. 1 is a perspective view showing an essential part of a panel in accordance with an exemplary embodiment of the present invention. FIG. 2 is an electrode array diagram of the panel in accordance with the exemplary embodiment. FIG. 3 is a block diagram of a plasma display device including the plasma display panel (PDP) in accordance with the exemplary embodiment. FIG. 4 is a structural diagram of a subfield in a method for driving the PDP in accordance with the exemplary embodiment.

Figure 26:
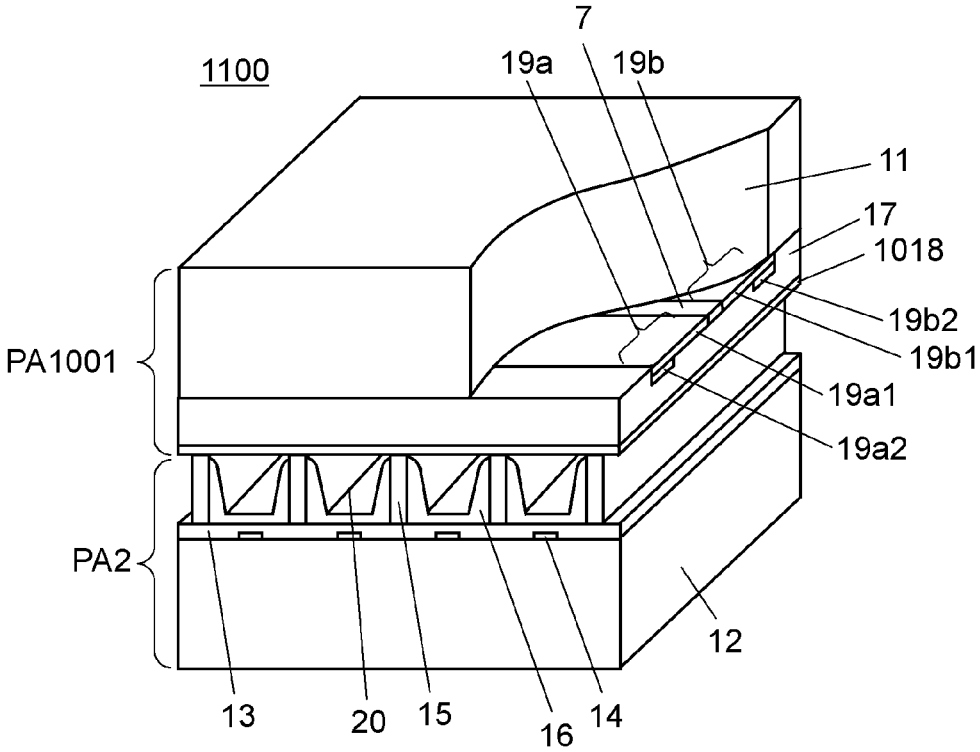
FIG. 26 is a perspective view showing an essential part of a conventional panel.
Figure 27:
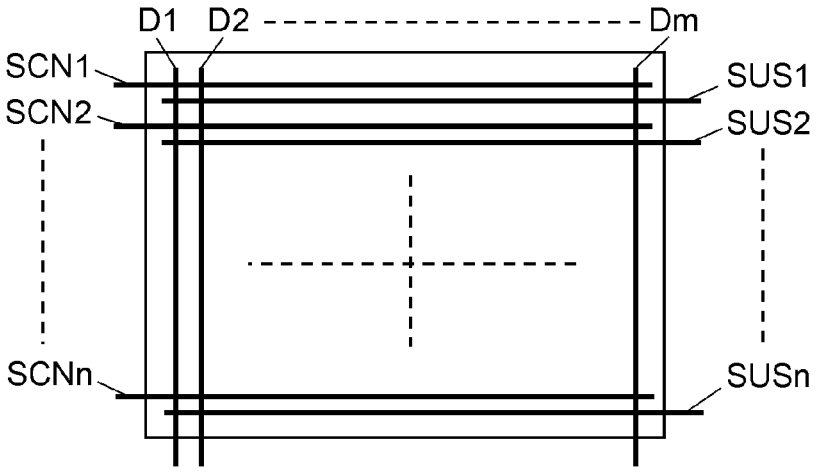
FIG. 27 is an electrode array diagram of the conventional panel.
Figure 28:
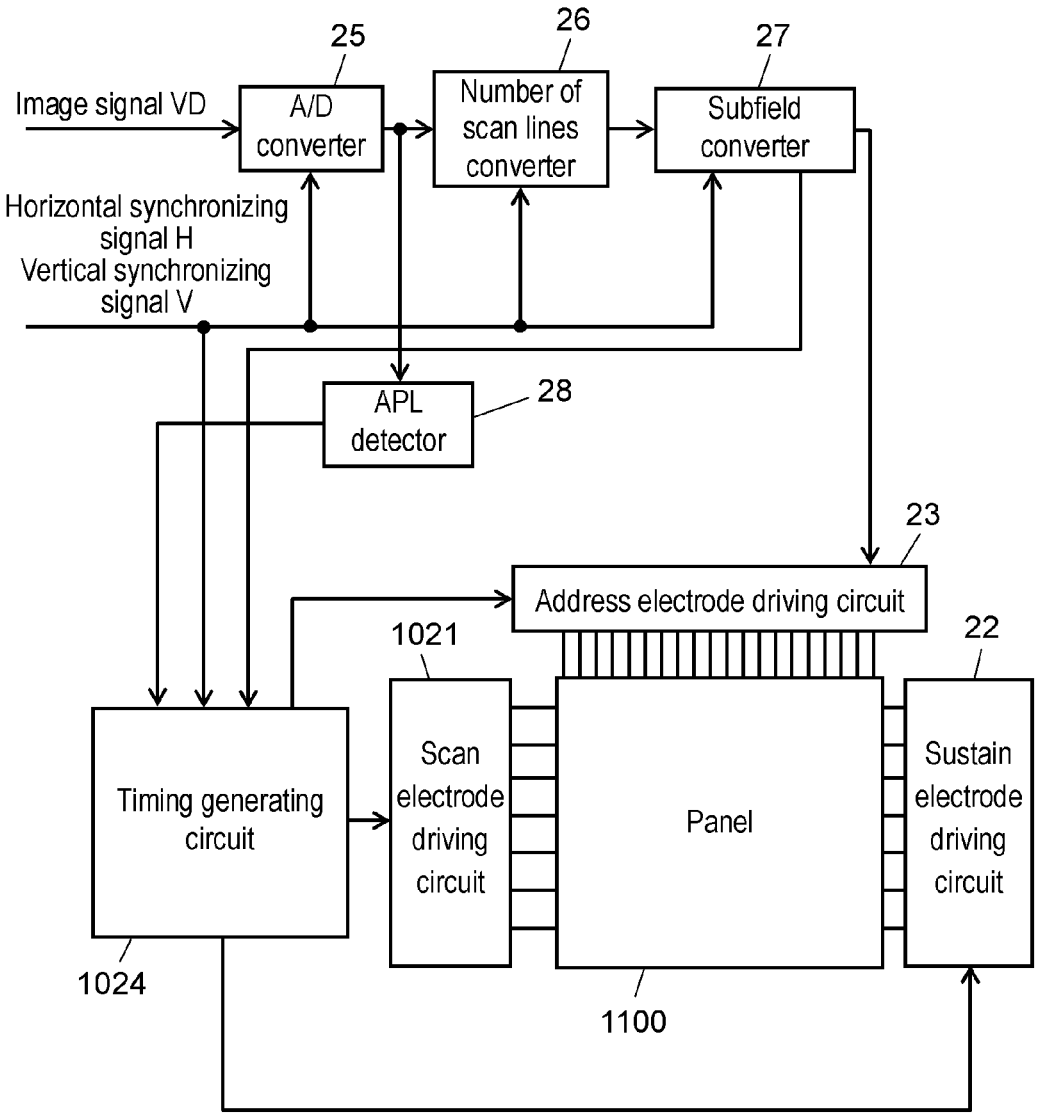
FIG. 28 is a block diagram of a plasma display device including the conventional PDP.
Figure 29:
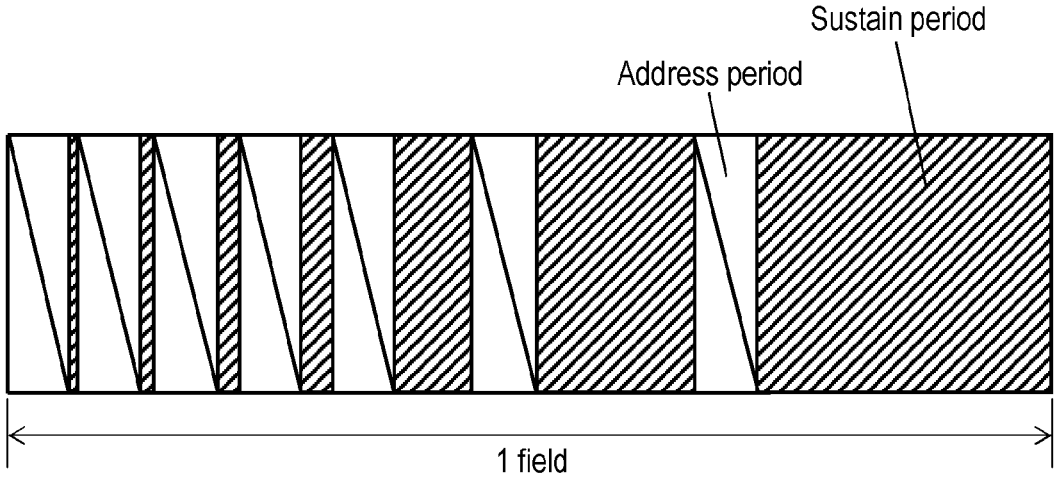
FIG. 29 is a structural diagram of a subfield in a method for driving the conventional PDP.
Figure 30:
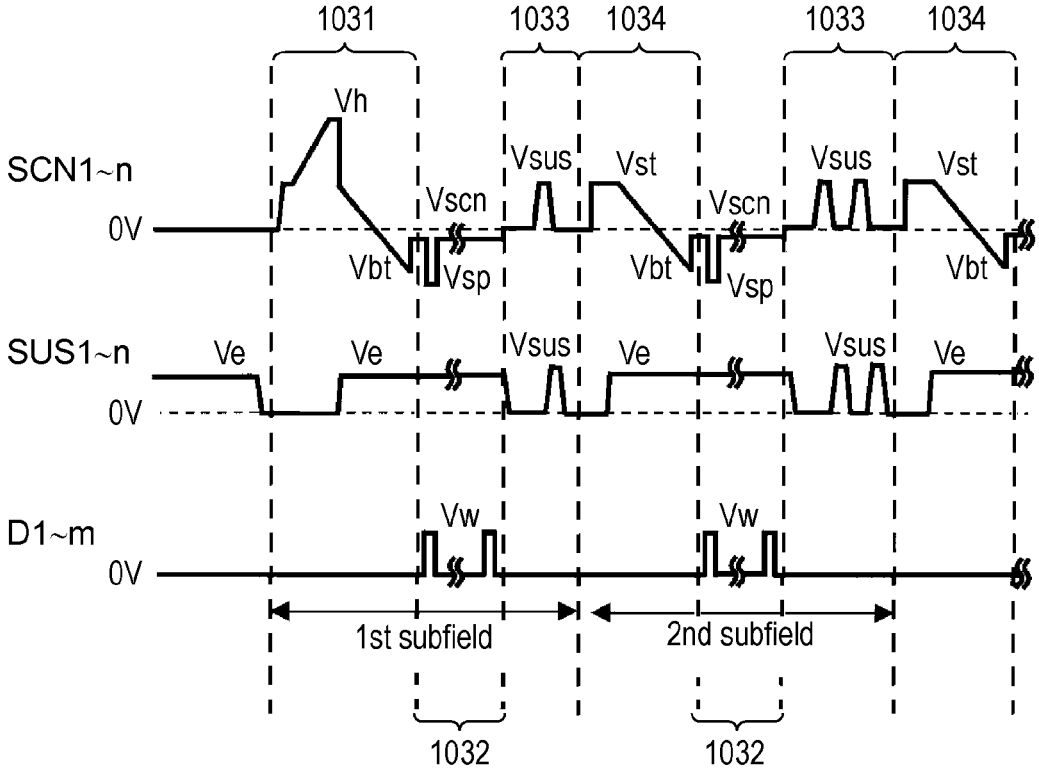
FIG. 30 is a timing chart of driving voltages applied to respective electrodes of the conventional PDP.

In the perspective view of FIG. 1 showing the essential part of the panel for use in the exemplary embodiment of the present invention, elements similar to those in the essential part of the conventional panel of FIG. 26 have the same reference marks. In the following descriptions, elements different from those in the essential part of the conventional panel of FIG. 26 are mainly described. In the block diagram of FIG. 3 that shows a plasma display device including the plasma display panel (PDP) of this exemplary embodiment, elements similar to those in the block diagram of FIG. 28 that shows the plasma display device including the conventional PDP have the same reference marks. In the following descriptions, elements different from those in the block diagram of the plasma display device including the conventional PDP shown in FIG. 28 are mainly described.

With reference to FIG. 1, sustain electrode 19*b* is a first electrode, scan electrode 19*a* is a second electrode, and address electrode 14 is a third electrode. A portion that has at least one pair of the first electrode and the second electrode, a dielectric layer formed so as to cover the first electrode and the second electrode, and protective layer 18 formed on the surface of dielectric layer 17 is generically referred to as a first substrate. A portion that has at least one of the third electrode, and a dielectric layer formed so as to cover the third electrode is generically referred to as a second substrate.

Figure 5:
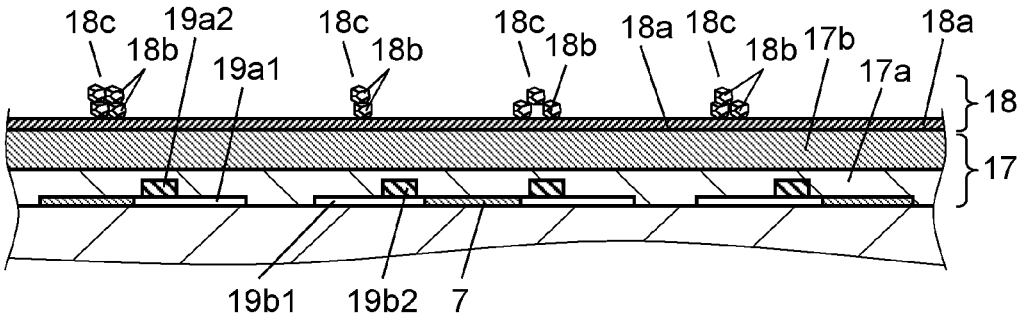
FIG. 5 is an explanatory view showing an enlarged state of a part of a protective layer of the PDP and vicinity of the part in accordance with the exemplary embodiment.

First, a description is provided of a structure and a manufacturing method for a protective layer, which is the feature of the panel of the PDP device in accordance with the present invention. FIG. 5 is an explanatory view showing an enlarged state of a part of the protective layer of the PDP and vicinity thereof in accordance with the exemplary embodiment of the present invention. In the PDP of the present invention, protective layer 18 has a structure as shown in FIG. 5. That is, base protective layer 18*a* that is made of magnesium oxide (MgO) containing aluminum (Al) as an impurity is formed on dielectric layer 17. Further, agglomerated particle groups 18*c* in which a plurality of crystal particles 18*b* of MgO, a metal oxide, agglomerate are discretely distributed on base protective layer 18*a*. The plurality of agglomerated particle groups 18*c* are attached so as to be distributed substantially uniformly across the entire surface. The present invention includes a case where agglomerated particle groups 18*c* are attached so as to be non-uniformly distributed.

Figure 6:
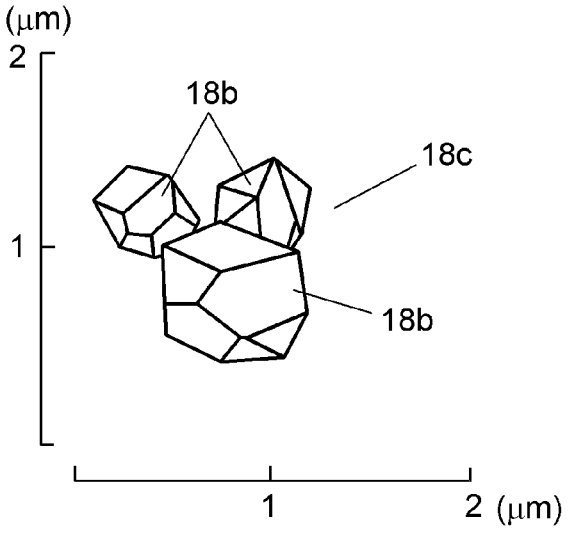
FIG. 6 is an enlarged view for explaining agglomerated particles in the protective layer of the PDP in accordance with the exemplary embodiment.

Agglomerated particle groups 18*c* are described. FIG. 6 is an enlarged view for explaining agglomerated particles in the protective layer of PDP 1 in accordance with the exemplary embodiment of the present invention. In agglomerated particle groups 18*c*, crystal particles 18*b* each having a predetermined primary particle diameter are agglomerated or necked. Crystal particles 18*b* are not bound by a strong binding force, as a solid, but are bound by static electricity or van del Waals force. Respective crystal particles 18*b* are bound by a binding force such that a part or the whole of the group is dispersed into crystal particles by an external stimulation, such as ultrasonic waves.

It is preferable that each crystal particle 18*b* has a diameter of approximately one micrometer (1 μm), and a polyhedric shape having at least seven faces, such as a tetradecahedron and dodecahedron. The diameter and shape of each primary particle of crystal particles 18*b* can be controlled by manufacturing methods.

For example, when an MgO precursor, such as magnesium carbonate and magnesium hydrate, is fired to provide crystal particles, the particle diameter can be controlled by adjusting the firing temperature and firing atmosphere. Typically, the firing temperature can be selected in the range of approximately 700° C. to 1,500° C. However, the firing temperature set to a relatively high temperature of at least 1,000° C. allows the primary particle diameter to be controlled to approximately 0.3 to 2 μm. Further, crystal particles 18*b* are produced by heating the MgO precursor. In the production process, agglomerated particle groups 18*c* in which a plurality of primary particles are bound with each other by a phenomenon called agglomeration or necking can be generated.

Figure 7:
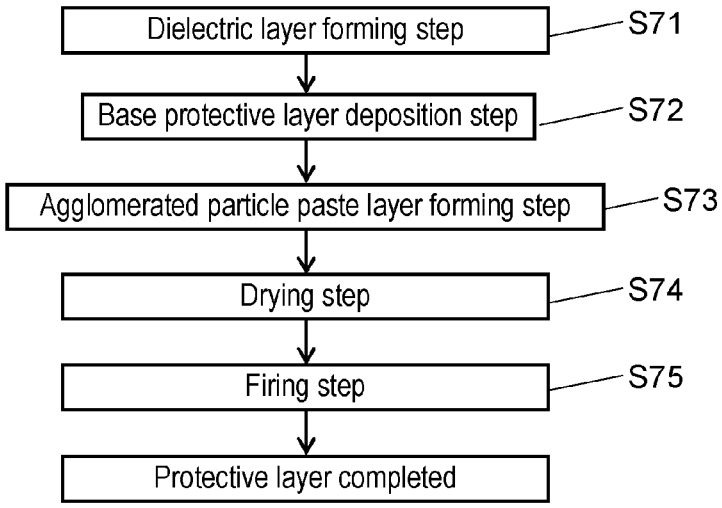
FIG. 7 is a chart showing steps of forming the protective layer in a method for manufacturing the PDP in accordance with the present invention.

Next, a description is provided of manufacturing steps of forming protective layer 18 in the PDP in accordance with the present invention. FIG. 7 is a chart showing the steps of forming the protective layer in a method of manufacturing the PDP in accordance with the present invention. As shown in the flowchart of the manufacturing process of FIG. 7, dielectric layer forming step S71 is performed to form dielectric layer 17 made of a laminated structure of first dielectric layer 17*a* and second dielectric layer 17*b*.

In base protective layer deposition step S72, base protective layer 18*a* made of MgO is formed on the surface of second dielectric layer 17*b* by a vacuum deposition method. In this deposition method, an MgO fired body containing Al as an impurity is used as a raw material.

A step is performed to discretely attach a plurality of agglomerated groups 18*c* to the surface of unfired base protective layer 18*a* that is formed in base protective layer deposition step S72. An agglomerated particle paste is prepared. In this paste, crystal particles 18*b* having a predetermined particle diameter distribution are mixed in a solvent together with a resin component. In agglomerated particle paste layer forming step S73, the agglomerated particle paste is applied to unfired base protective layer 18*a* by screen printing, so that an agglomerated particle paste layer is formed. The methods for forming the agglomerated particle paste layer include a spray method, spin coating method, die coating method, and slit coating method, in addition to the screen printing.

After the agglomerated particle paste layer is formed, drying step S74 of drying the agglomerated particle paste layer is performed.

Next, unfired base protective layer 18*a* formed in base protective layer deposition step S72 and the agglomerated particle paste layer having undergone drying step S74 are fired simultaneously, in firing step S75 of heating and firing the layers at temperatures of several hundred degrees. Thereby, solvents and resin components remaining in the agglomerated particle paste layer are removed. These steps can provide protective layer 18 that includes a plurality of agglomerated particle groups 18*c* attached to base protective layer 18*a*. With this method, the plurality of agglomerated particle groups 18*c* can be attached to base protective layer 18*a* so as to be distributed uniformly across the entire surface of the base protective layer. With the above steps, a plasma display panel is manufactured.

Other than the above method, the following methods can be used. Crystal particles suspended in a gas may be sprayed together with the gas, without the use of any solvent. The crystal particles may be precipitated by gravity, instead of being sprayed.

Figure 8:
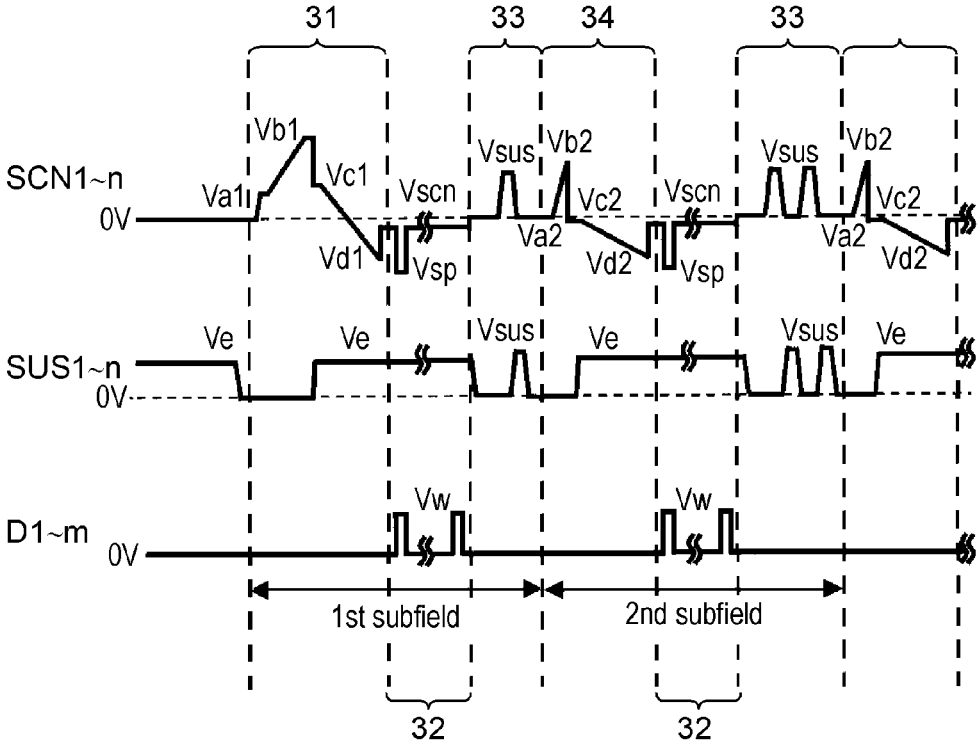
FIG. 8 is a timing chart of driving voltages applied to respective electrodes of the PDP in a driving method in accordance with the present invention.

Next, a description is provided of driving waveforms in the initializing periods in a method for driving the PDP of the present invention and a driving circuit thereof. FIG. 8 is a timing chart of driving voltages applied to respective electrodes of PDP 1 in the driving method in accordance with the present invention. For the PDP driving waveforms of the present invention, as shown in FIG. 8, first half T1 of the initializing period and second half T2 of the initializing period are set in all-cell initializing period 31 of each subfield (SF). In the first half, scan electrodes 19*a* are applied with a voltage gradually rising from first voltage Va1 to second voltage Vb1 (see FIG. 12). In the second half, the scan electrodes are applied with a voltage gradually falling from third voltage Vc1 to fourth voltage Vd1 (see FIG. 12).

Figure 9:
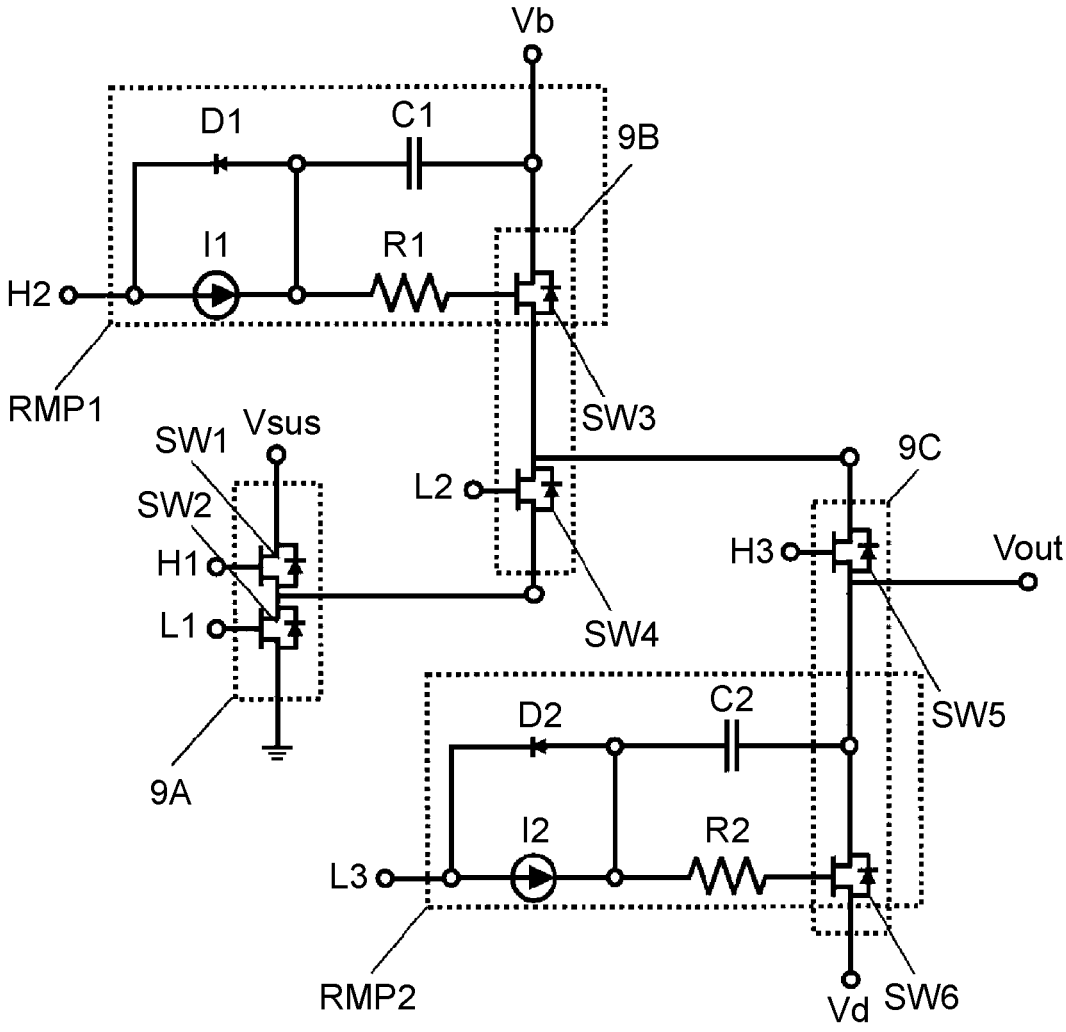
FIG. 9 is a diagram showing an example of a driving circuit configuration for outputting a driving waveform in accordance with the exemplary embodiment of the present invention.

A structure of sustain electrode driving circuit 22 for generating PDP driving waveforms of the present invention is shown in FIG. 9. This sustain electrode driving circuit has power supply Vb for applying a gradually rising voltage in first half T1 of the initializing period, and controls the output of a voltage of positive polarity, using a separator circuit. The sustain electrode driving circuit also has power supply Vd for applying a gradually falling voltage in second half T2 of the initializing period, and controls the output of a voltage of negative polarity, using a separator circuit.

Separator circuit 9B for controlling the output of voltage Vb of positive polarity is connected to the output terminal of circuit 9A for controlling the output of sustain voltage Vsus. Separator circuit 9C for controlling the output of voltage Vd of negative polarity is connected to the output terminal of circuit 9B. Ramp generating circuit RMP1 composed of constant current circuit I1, capacitor C1, diode D1, resistor R1, and power supply Vb is connected between the gate and drain of high-side switch SW3 of separator circuit 9B. Ramp generating circuit RMP2 composed of constant current circuit 12, capacitor C2, diode D2, resistor R2, and power supply voltage Vd is connected between the gate and drain of low-side switch SW6 of separator circuit 9C. With the driving circuit configured as above, a voltage gradually rising in first half T1 of the all-cell initializing period, and a voltage gradually falling in second half T2 of the all-cell initializing period can be applied to scan electrodes 19*a*. FIG. 9 shows an example of a circuit configuration for outputting ramp voltages, and the present invention is not limited to this circuit configuration.

Next, a description is provided of experiments conducted to validate advantages of a plasma display device of the present invention.

(Validation Experiment 1)

Four samples of PDP 1 that have protective layers 18 and agglomerated particle groups 18*c* different in structure are produced. The four samples are following Prototype 1 through Prototype 4.

Prototype 1: PDP that has a protective layer simply made of MgO

Prototype 2: PDP that has a protective layer made of MgO doped with an impurity, such as Al and Si Prototype 3: PDP in which only crystal primary particles made of a metal oxide are sprayed on the surface of base protective layer 18*a* made of MgO, and attached to base protective layer 18*a*

Prototype 4: Prototype in accordance with the present invention. PDP in which agglomerated particle groups formed by agglomerating crystal primary particles are attached to the surface of base protective layer 18*a* made of MgO so as to be substantially uniformly distributed across the entire surface of the base protective layer In Prototype 3 and Prototype 4, MgO single-crystal particles are used as the metal oxide.

Figure 10:
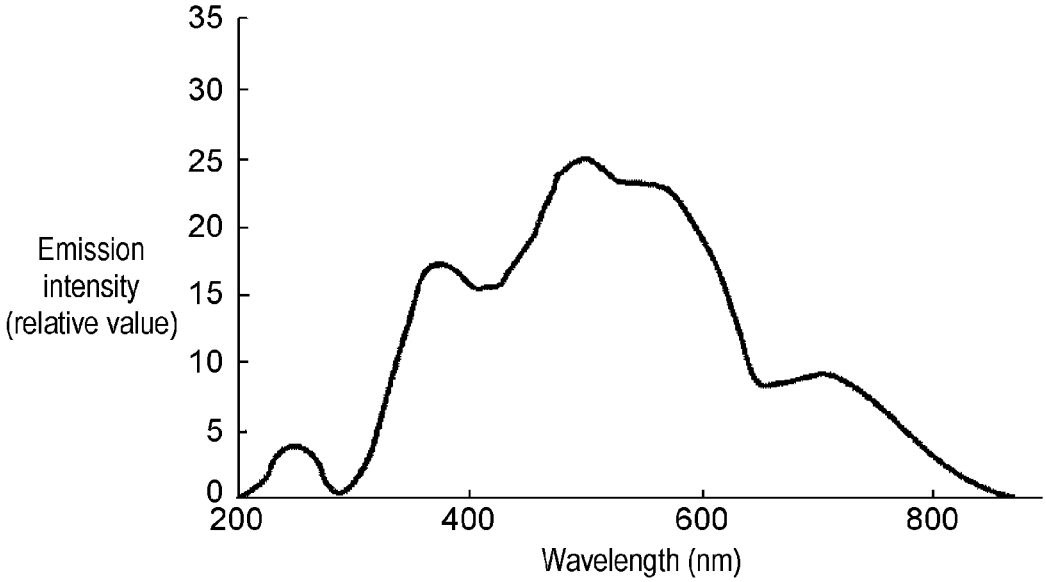
FIG. 10 is a characteristics diagram showing a cathode luminescence analysis of crystal particles.

In Prototype 4 of the present invention, the agglomerated particle groups attached to the surface of base protective layer 18*a* are irradiated with electron beams for cathode luminescence analysis. The characteristics shown by the curve of FIG. 10 are obtained. The abscissa axis shows wavelength and the ordinate axis shows relative values of emission intensity.

In the PDPs formed of four types of protective layer, i.e. Prototype 1 through Prototype 4, electron emission capability and electric charge retention capability are measured. The electron emission capability and the charge retention capability are described.

The electron emission capability is determined by the number of electrons (current density) per unit area and per unit time that are emitted from the surface of the protective layer including base protective layer 18*a* and agglomerated particle groups. The following description is an example of considered methods for measuring the density of the current flowing from the protective layer to discharge part 20. The method includes the steps of: breaking a prototype; placing samples of the broken pieces of the front plate in a vacuum chamber; capturing electrons emitted by the external electric field into the space; and detecting the electrons, using a photomultiplier. However, it is difficult to measure the density of the current from the protective layer while the PDP is actually driven.

Then, statistical delay time Ts of discharge is used as a measurand correlated with the current density until the time of discharge. The temporal discharge delay from voltage application to the discharge peak is interpreted as the sum of formation delay time Tf and statistical delay time Ts of the discharge. The discharge delay time is dependent on applied voltage and electron number density in the gas before the start of the discharge. Formation delay time Tf is correlated with the applied voltage. Statistical delay time Ts is correlated with the electron number density in the gas before the start of the discharge. Until the start of the discharge, statistical delay time Ts is measured at each time instant as a function of time. The inverse number of statistical delay time Ts is in proportional to the current density of electrons from the protective layer covering the discharge gas. Integrating the inverse number of statistical delay time Ts with respect to time, as a function of time until the start of the discharge allows relative comparison between the amounts of electron emission from the protective layer per unit area. Herein, statistical delay time Ts is measured for relative comparison of electron emission capability between the prototypes.

Next, the charge retention capability is described. As an index of the charge retention capability, voltage Vscn applied in the address periods is used. After an initializing operation is completed and before an address operation is performed, loss of the wall charges desired for the address operation is prevented. Thus voltage Vscn of reverse polarity of the wall potential is applied to scan electrodes 19*a* in order to suppress the loss of the wall charges in the standby period of the address operation.

When the accumulated wall charges are easily lost by exchange of the charges with the surface current of protective layer 18 and the discharge gas, voltage Vscn tends to be increased. Lower voltage Vscn shows the higher charge retention capability. In many of existing products, an element having a breakdown voltage of approximately 150 V is used as a semiconductor switching element for sequentially applying a scan voltage to the panel, such as a metal oxide semiconductor field-effect transistor (MOSFET). Thus, in consideration of damages caused by heat generation of the switching element, it is preferable to suppress voltage Vscn to 120 V or lower. Herein, lowest scan voltage Vscn necessary for the address operation is measured for comparison of the charge retention capability between the prototypes.

Figure 11:
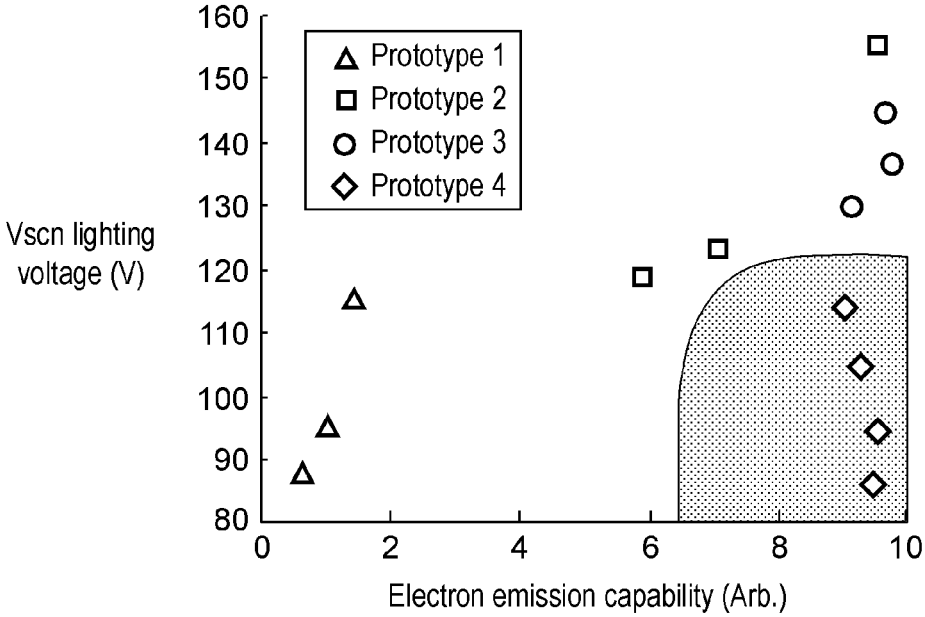
FIG. 11 is a characteristics diagram that shows a relation between electron emission capabilities and Vscn lighting voltages indicating charge retention capabilities, in experiments for validating an advantage of the plasma display device in accordance with the present invention.

FIG. 11 shows the examination results of the electron emission capability and the charge retention capability. The abscissa axis shows electron emission capabilities and the ordinate axis shows Vscn lighting voltages as the charge retention capability. Prototype 1 through Prototype 4 is plotted. The obtained characteristics of Prototype 4 in accordance with the present invention are as follows: the electron emission capability is 6 or higher, and charge retention capability is such that Vscn voltage is 120 V or lower. For each of Prototype 2 and Prototype 3 having a higher electron emission capability, Vscn voltage is 120 V or higher, which shows a poor charge retention capability. In contrast, Prototype 1 having a higher charge retention capability exhibits a poor electron emission capability of 2 or lower.

(Validation Experiment 2)

Prototype 5 and Prototype 6 are produced. Prototype 5 has a protective layer made of MgO doped with an impurity, such as Al and Si (the amount of the dopant being different from that of Prototype 2). In Prototype 6 (identical with Prototype 4), agglomerated particle groups formed by agglomerating crystal primary particles are attached to a protective layer made of MgO so as to be substantially uniformly distributed across the entire surface of the protective layer.

Between these prototypes, likelihood of generating a strong discharge in an all-cell initializing period is compared. Thus the strong discharge inhibiting effect of Prototype 6 of the present invention in the all-cell initializing period is validated.

In the experiments, an avalanche photo-diode (hereinafter, an APD) for near-infrared rays, e.g. a receiver of optical signals, is used as a measuring device. The intensity of discharge in the all-cell initializing period is observed from the output of the APD. The intensity of discharge can be determined by the amount of near-infrared rays generated during radiation caused by excitation state transition of xenon. For a strong discharge, the amount of near-infrared rays generated is increased.

Figure 12:
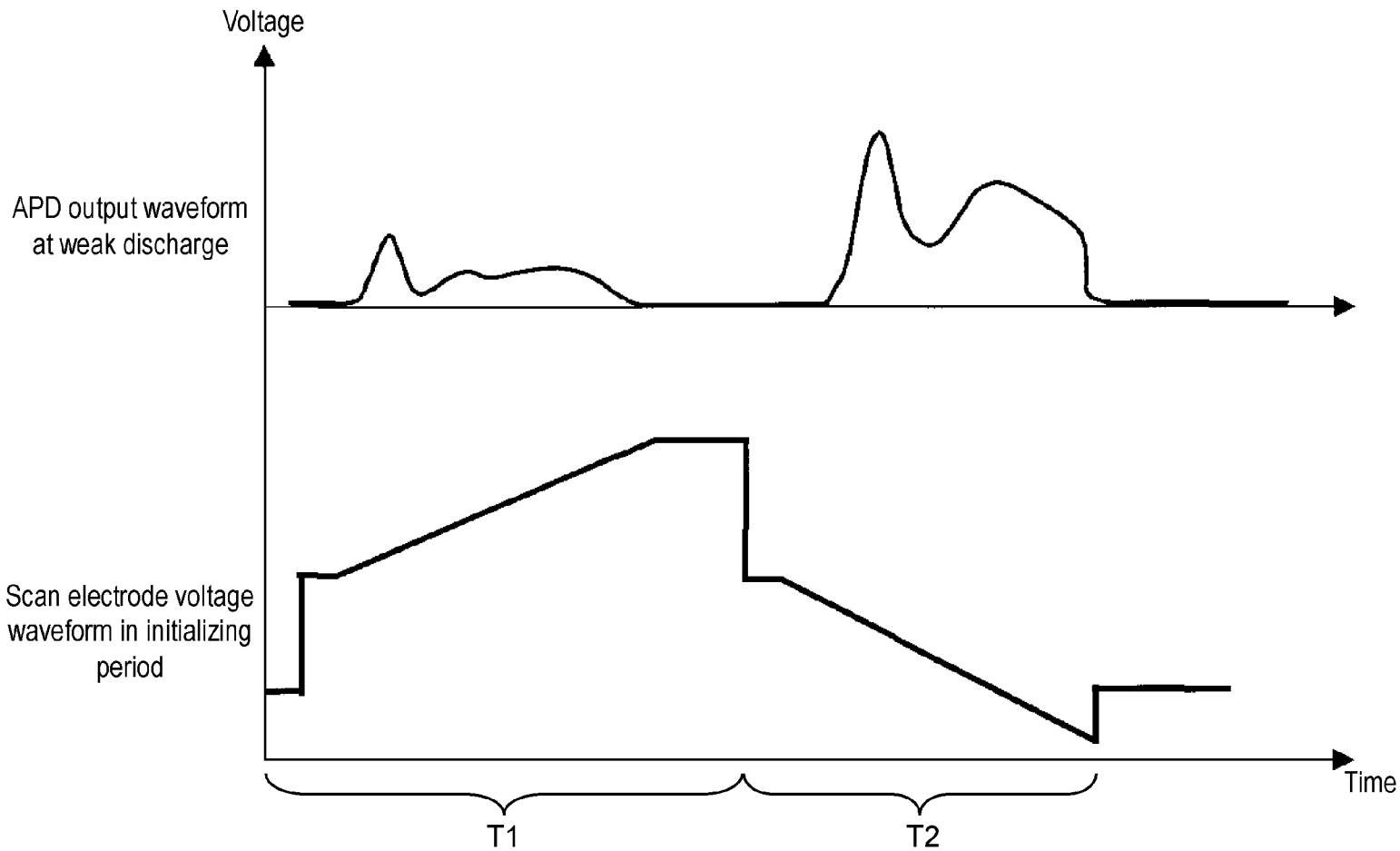
FIG. 12 is a diagram showing avalanche photodiode (APD) output voltages for a weak discharge in an all-cell initializing operation.
Figure 13:
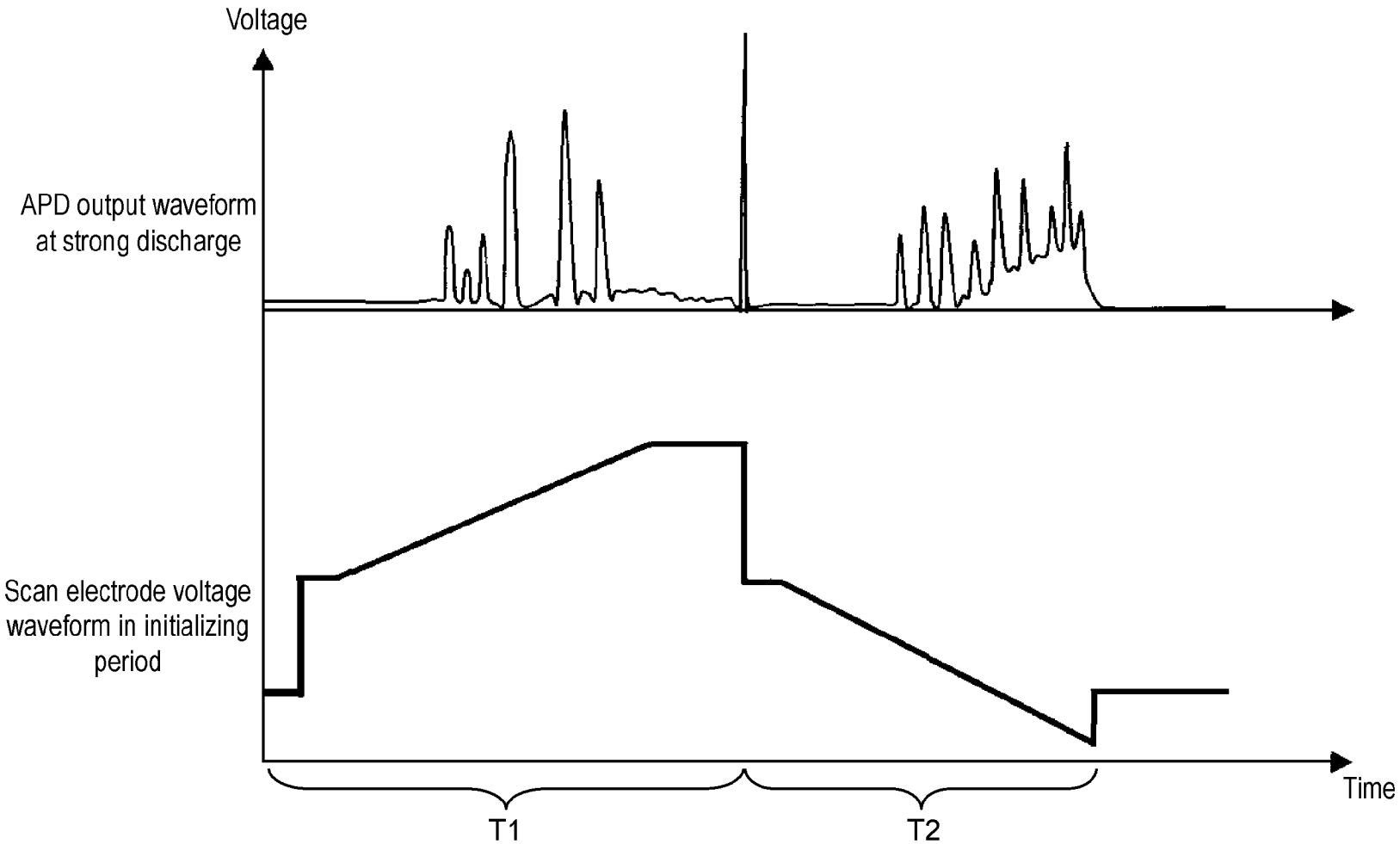
FIG. 13 is a diagram showing APD output voltages for a strong discharge in the all-cell initializing operation.

For example, FIG. 12 shows a diagram of an APD output waveform when a weak discharge is generated in an all-cell initializing period. FIG. 13 shows a diagram of an APD output waveform when a strong discharge is generated in the all-cell initializing period. In FIG. 12 and FIG. 13, the abscissa axis shows time, and the ordinate axis shows voltages.

With reference to FIG. 12, in first half T1 of the initializing period, scan electrodes 19*a* are applied with a positive voltage. The potential difference including wall potential in the inside or on the surfaces of discharge part 20 in the periphery of the electrodes is higher than the potential difference at the start of the discharge. In this case, temporally rapid electrolytic dissociation does not occur, but a gradually proceeding weak discharge occurs stably. In second half T2 of the initializing period in which the voltage applied to scan electrodes 19*a* changes from a positive voltage to a negative voltage, the excessive wall charges in the wall charge accumulated in first half T1 of the initializing period are removed, so that the wall charges are adjusted. With the weak discharge in first half T1 and second half T2 of the initializing period, wall charges desired for the address discharge can be accumulated in the periphery of scan electrodes 19*a* and address electrodes 14 in discharge part 20.

With reference to FIG. 13, in first half T1 of the initializing period, scan electrodes 19*a* are applied with a positive voltage. The potential difference including wall potential in the inside or on the surfaces of discharge part 20 in the periphery of the electrodes is higher than the potential difference at the start of the discharge. In this case, temporally rapid electrolytic dissociation proceeds, and a strong discharge occurs. In second half T2 of the initializing period in which the voltage applied to scan electrodes 19*a* changes from a positive voltage to a negative voltage, the excessive wall charges accumulated in first half T1 of the initializing period cause a strong discharge again when the voltage applied to scan electrodes 19*a* falls from the peak voltage.

In this manner, while whether a strong discharge has occurred in the all-cell initializing period or not is monitored using the APD, the slope limit of the ramp voltage at which a strong discharge occurs in the first half of the initializing period is measured for Prototype 5 and Prototype 6 with the panel temperature changed. Here, constant-current circuit I1 of ramp voltage generating circuit RMP1 has a circuit configuration including the combination of a p-type semiconductor, a MOSFET, and a volume resistor, and is used for control. When a strong discharge occurs in a cell, light emission in the cell is stronger than that in other cells generating a weak discharge. Thus the occurrence of the strong discharge can be visually recognized. Then, the strong discharge is monitored both visually and using the APD.

Figure 14:
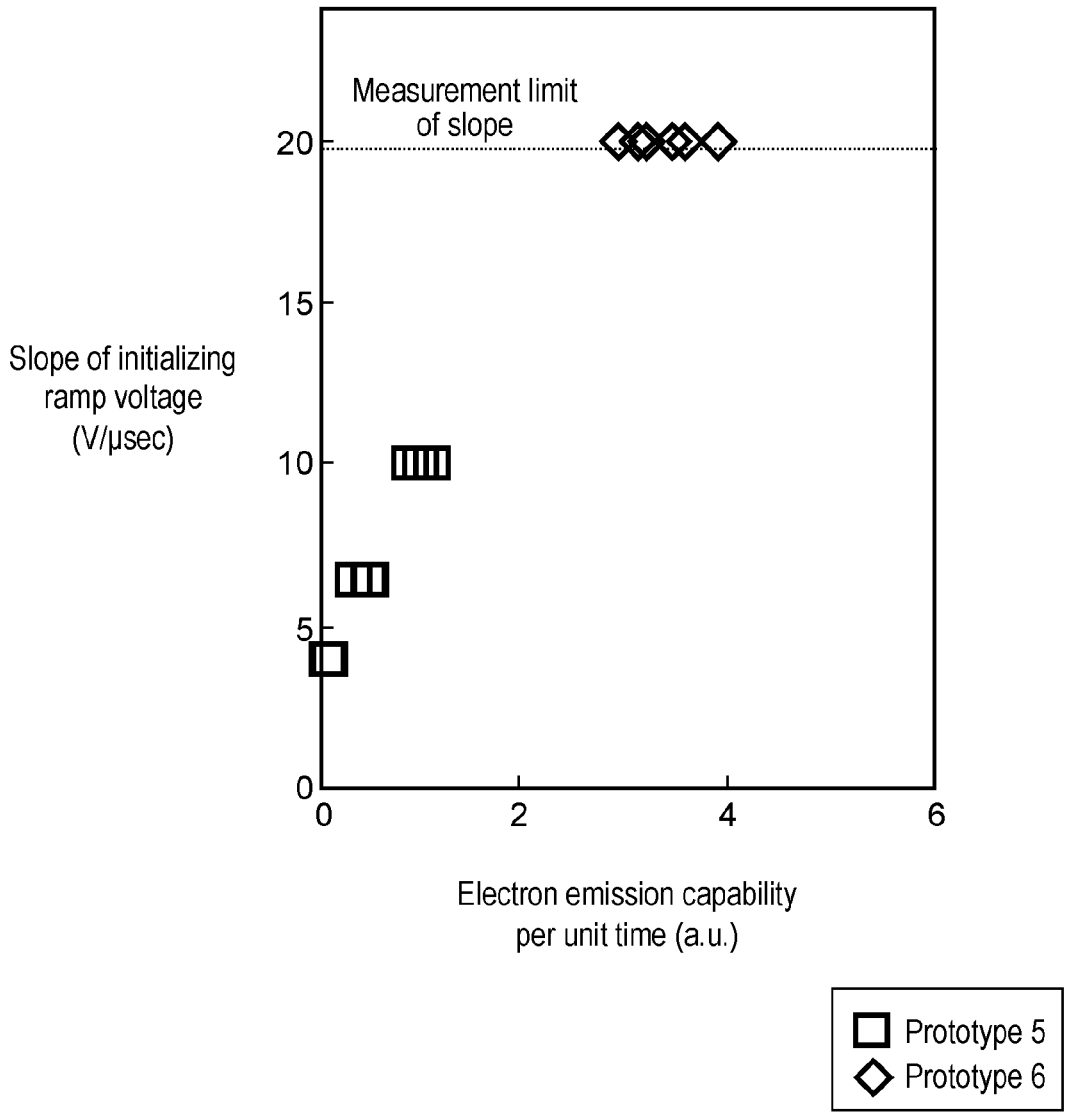
FIG. 14 is a characteristics diagram showing a relation between electron emission capabilities and a slope limit of initializing ramp voltages in experiments for validating advantages of the plasma display device in accordance with the present invention.

The electron emission capability at each panel temperature is known from a pre-experiment to be described later. This experiment has clarified the relation between the electron emission capability and a slope limit. FIG. 14 shows results of this experiment. With reference to FIG. 14, the abscissa axis shows electron emission capabilities per unit time, and the ordinate axis shows slopes of the initializing ramp voltage.

According to the result, for Prototype 5, the electron emission capability is considerably degraded at a low panel temperature, and the slope of the ramp voltage needs to be made gentler. In contrast, for Prototype 6, irrespective of panel temperature, no strong discharge occurs even when the slope of the ramp voltage is set to 20 V/μsec, i.e. the measurement limit of the evaluating device. In FIG. 14, the slope limit in Prototype 6 is plotted as 20 V/μsec.

In Prototype 5, in order for a strong discharge in the all-cell initializing period to be prevented, the slope of the ramp voltage needs to be made gentler. Thus the initializing period needs to be extended. As a result, measures for shortening the sustain period or address period are taken.

However, shortening the sustain period poses a greater problem in increasing definition. A high-definition PDP has a finer pitch. Thus the metal electrodes and barrier ribs make up a large proportion of a pixel. This structure decreases the aperture ratio and luminance. Further, extending the initializing period and shortening the sustain period in order to prevent the above strong discharge reduces the maximum number of sustain pulses and lowers the peak luminance. These factors considerably degrade the contrast in bright portions and thus the image quality in a high-definition PDP.

Figure 15:
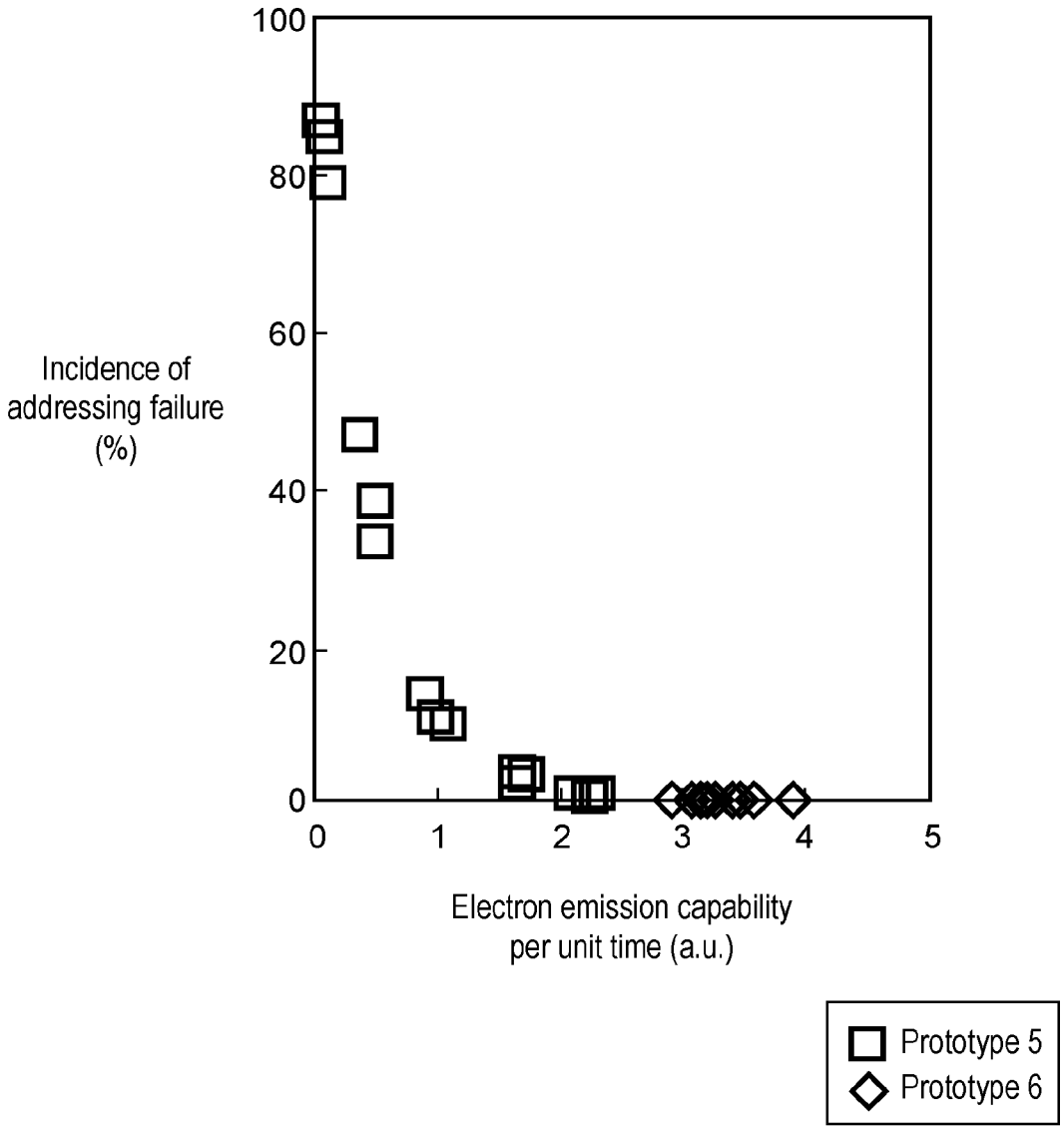
FIG. 15 is a characteristics diagram showing a relation between electron emission capabilities and probabilities of addressing failures in the experiments for validating the advantages of the plasma display device in accordance with the present invention.

Further, shortening the address period makes the cycle of the scan voltage shorter than the discharge delay time. Thus a normal address operation cannot be performed. For example, FIG. 15 shows a relation between electron emission capabilities and incidences of addressing failures when the cycle of the scan voltage is set to 1.2 μsec. In FIG. 15, the abscissa axis shows electron emission capabilities per unit time, and the ordinate axis shows probability of addressing failures. For Prototype 5, at a lower panel temperature, the electron emission capability is degraded, and the discharge delay time is increased. Thus normal address operation cannot be performed. In contrast, for Prototype 6 of the present invention, no addressing failure occurs and stable address operation can be performed.

As obvious from the above results, Prototype 5 cannot satisfy both prevention of a strong discharge in the initializing period and time restrictions on the sustain period and address period.

Figure 16:
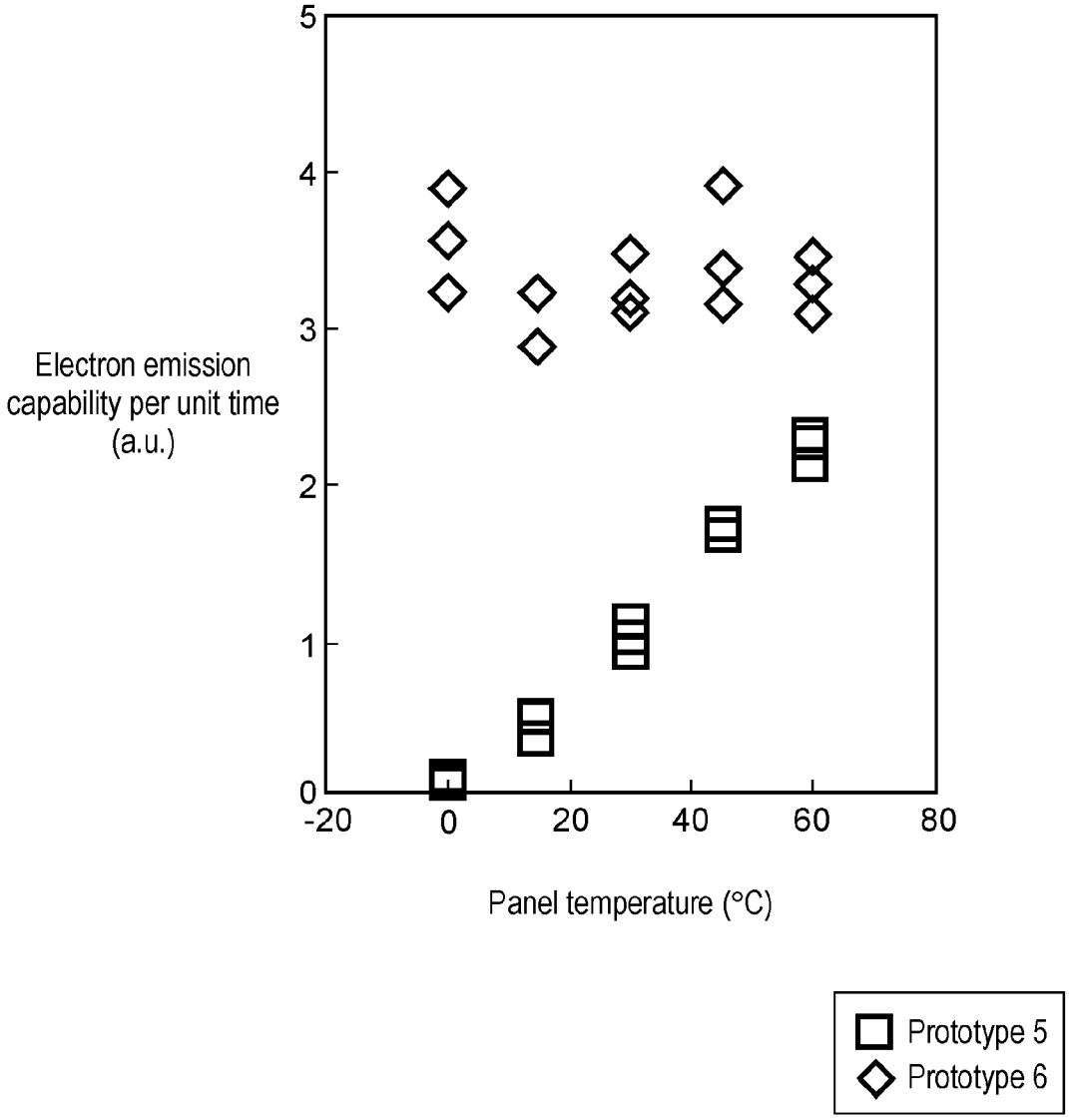
FIG. 16 is a characteristics diagram showing a relation between panel temperatures and electron emission capabilities in the experiments for validating an advantage of the plasma display device in accordance with the present invention.

The above pre-experiment is described. The pre-experiment is conducted to obtain a relation between the relative values of the electron emission capability calculated from the inverse number of statistical delay time Ts and the panel temperatures. FIG. 16 shows the results. In FIG. 16, the abscissa axis shows panel temperatures, and the ordinate axis shows electron emission capabilities per unit time. Herein, the electron emission capability of Prototype 5 at a panel temperature of 30° C. is set to 1, and the relative values of the electron emission capability are calculated at other panel temperatures and for Prototype 6.

FIG. 16 shows that, in Prototype 5, the electron emission capability per unit time is rapidly degraded with a drop in panel temperature. In contrast, Prototype 6 maintains stably high electron emission capabilities irrespective of panel temperature.

(Validation Experiment 3)

Figure 17:
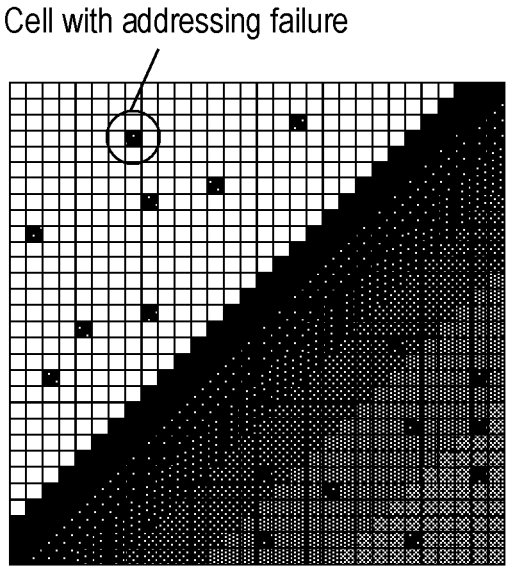
FIG. 17 is a photograph of an image displayed on a display device that shows a state when a driving waveform of the present invention is applied in experiments for validating an advantage of the plasma display device in accordance with the present invention.
Figure 18:
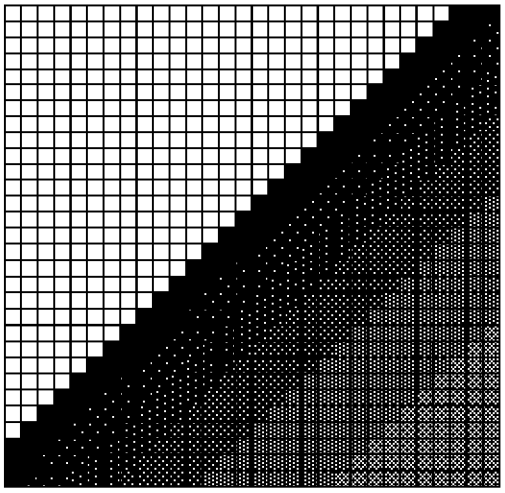
FIG. 18 is a photograph of an image displayed on the display device that shows a state when a driving waveform of the present invention is applied in the experiments for validating the advantage of the plasma display device in accordance with the present invention.

Prototype 6 of the present invention is applied with a driving waveform in the conventional driving method and a driving waveform of the present invention, and lighting failures caused by discharge interference between adjacent cells are compared. The driving waveform in the conventional driving method is denoted as driving waveform DWF1, and the driving waveform of the present invention is denoted as driving waveform DWF2. For driving waveform DWF1 in the conventional driving method, an erasing voltage in a rectangular waveform having a rise of 37 V/μsec is applied in a selective initializing period. For driving waveform DWF2, a ramp voltage gradually rising at 10 V/μsec is applied in the first half of the selective initializing period. FIG. 17 shows lighting caused by driving waveform DWF1. FIG. 18 shows lighting caused by driving waveform DWF2.

As obvious from FIG. 17, in the case of driving method using DWF1 for applying a rectangular waveform in the selective initializing period, many cells having lighting failures are observed. In contrast, as shown in FIG. 18, in the case of driving waveform DWF2 for applying a ramp voltage gradually rising in the selective initializing period, no cells having lighting failures are observed. With driving waveform DWF1, a strong discharge occurs in the selective initializing period, and the discharge interference between the adjacent cells is large. With driving waveform DWF2, a weak discharge occurs in the selective initializing period, and the discharge interference between the adjacent cells is small. The intensity of the discharge in the selective initializing period caused by each driving waveform is checked, using an APD.

Prototype 6 has variations in the degree of discharge interference caused by variations in the thickness of the dielectric layers of the panel, for example. The slope of the ramp voltage in the first half of the selective initializing period at which image display fails is determined. As a result, the slope limit ranges from 25 V/μsec to 35V/μsec inclusive, both in rising and falling ramp voltages.

In the present invention, occurrence of a strong discharge is suppressed both in an all-cell initializing period and a selective initializing period, and a stable address operation can be performed at Vscn voltage of 120V or lower. Thus a plasma display device having high definition and high quality can be provided at a low price.

FIRST EXAMPLE

A description is provided of a plasma display device that includes a plasma display panel (PDP) having protective layer 18. In the protective layer, crystal particles 18*b* have an average particle diameter ranging from 0.9 μm to 2 μm inclusive. In the following descriptions, the particle diameter means an average particle diameter, and the average particle diameter indicates a volume cumulative average diameter (D50). The particle diameter can be measured through scanning electron microscopy (SEM) observation.

Figure 19:
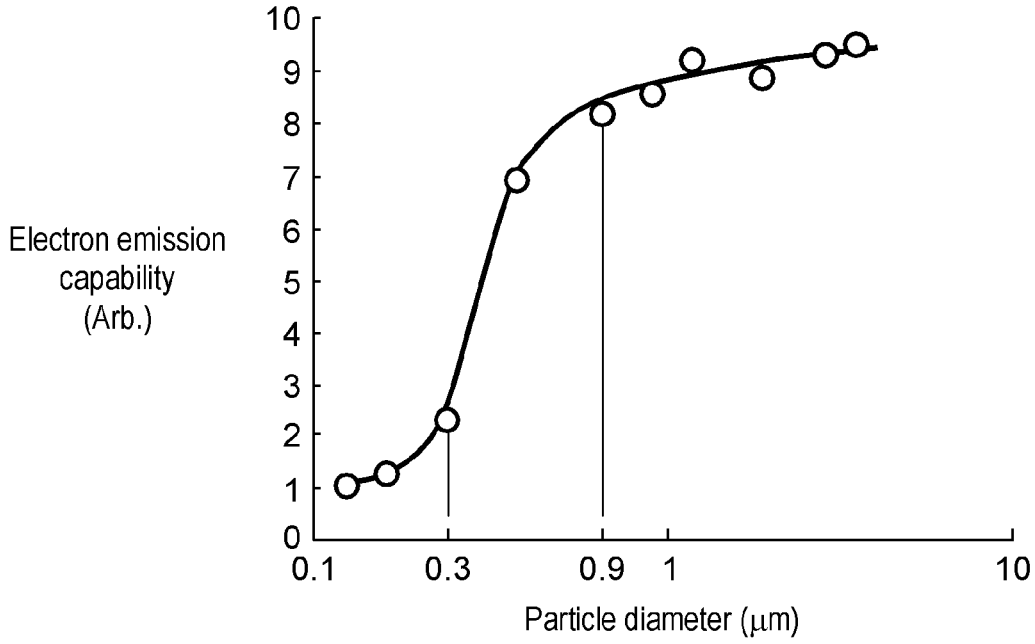
FIG. 19 is a characteristics diagram showing a relation between particle diameters of the crystal particles and electron emission characteristics.

In Prototype 4 of the present invention described with reference to FIG. 11, electron emission capability is examined with the diameter of MgO crystal particles changed. FIG. 19 shows the results. In FIG. 19, the abscissa axis shows the particle diameters, and the ordinate axis shows the electron emission capabilities.

For a particle diameter as small as approximately 0.3 μm, the electron emission capability is low. For a particle diameter of approximately 0.9 μm or larger, a high electron emission capability can be obtained.

Figure 20:
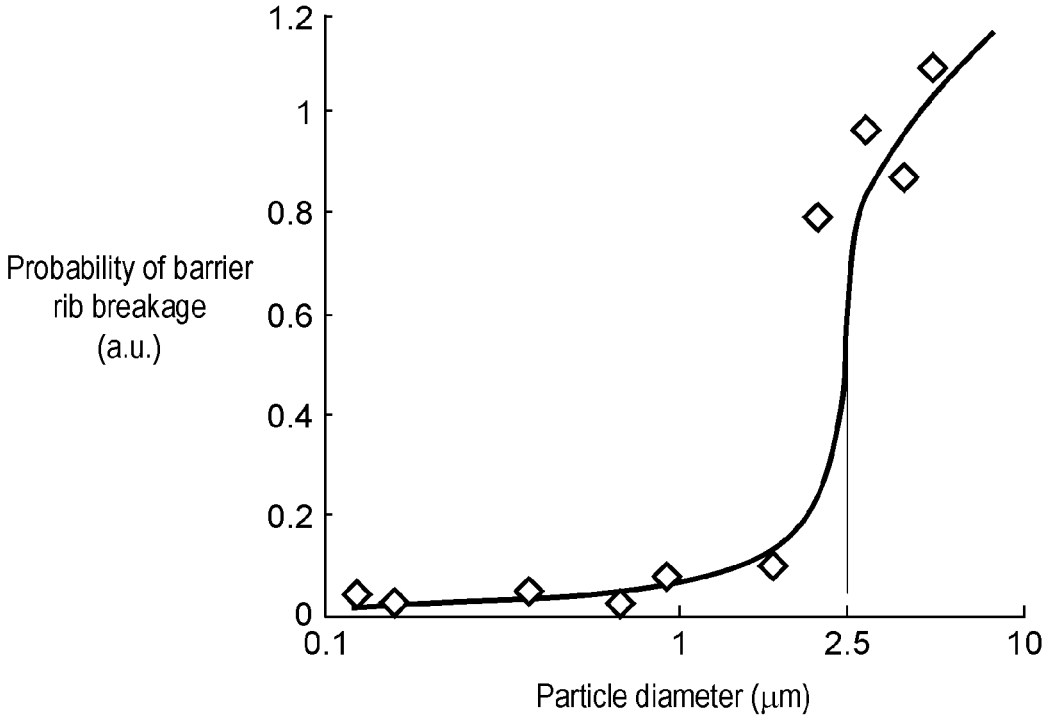
FIG. 20 is a characteristics diagram showing a relation between the particle diameters of the crystal particles and probability of barrier rib breakage.

Next, in Prototype 4 of the present invention described with reference to FIG. 11, a fixed number of crystal particles per unit area that have different particle diameters are distributed on the surface of protective layer 18, and the probability of breakage of barrier ribs is accessed. FIG. 20 shows the results. In FIG. 20, the abscissa axis shows the particle diameters, and the ordinate axis shows the probability of barrier rib breakage. In order to increase the electron emission number in discharge cells, it is preferable that the number of crystal particles on protective layer 18 per unit area is large. However, in a case where protective layer 18 of front plate PA1 is in intimate contact with the top parts of barrier ribs 15 of rear plate PA2 and crystal particles exist between the top parts and the front plate, a part of the barrier ribs is broken when front plate PA1 and rear plate PA2 are sealed together. A part of materials of the broken barrier ribs falls into discharge part 20, and causes a failure in which cells are not lit or unlit normally. The failure caused by breakage of barrier ribs is conspicuous particularly when many crystal particles exist on the top parts of the barrier ribs. Thus, when a larger number of crystal particles are attached, the probability of barrier rib breakage is higher.

As obvious from FIG. 20, when the particle diameter of crystal particles reaches as large as approximately 2.5 μm, the probability of barrier rib breakage is suddenly increased. In contrast, for crystal particles having a particle diameter smaller than 2.5 μm, the probability of barrier rib breakage can be suppressed relatively low.

According to the above results, and in consideration of variations in producing crystal particles 18*b* and in the process of forming protective layer 18, crystal particles having a particle diameter ranging from 0.9 μm to 2.0 μm inclusive are preferable.

Further, in order for base protective layer 18*a* to be prevented from damage by ion sputtering of the discharge gas, it is preferable that the agglomerated particle groups and base protective layer 18*a* are made of materials of the same quality in the process of re-crystallization after ion sputtering. Thus it is preferable that base protective layer 18*a* is also made of MgO of the same quality as that of crystal particles 18*b*.

The first example of the present invention can provide an electron emission capability of 6 or higher, and a charge retention capability such that Vscn voltage is 120 V or lower. Thus, as protective layer 18 in a high-definition PDP, both electron emission capability and charge retention capability can be satisfied. Therefore, a PDP that has display performance of high definition and high luminance, and low power consumption can be implemented.

SECOND EXAMPLE

Figure 21:
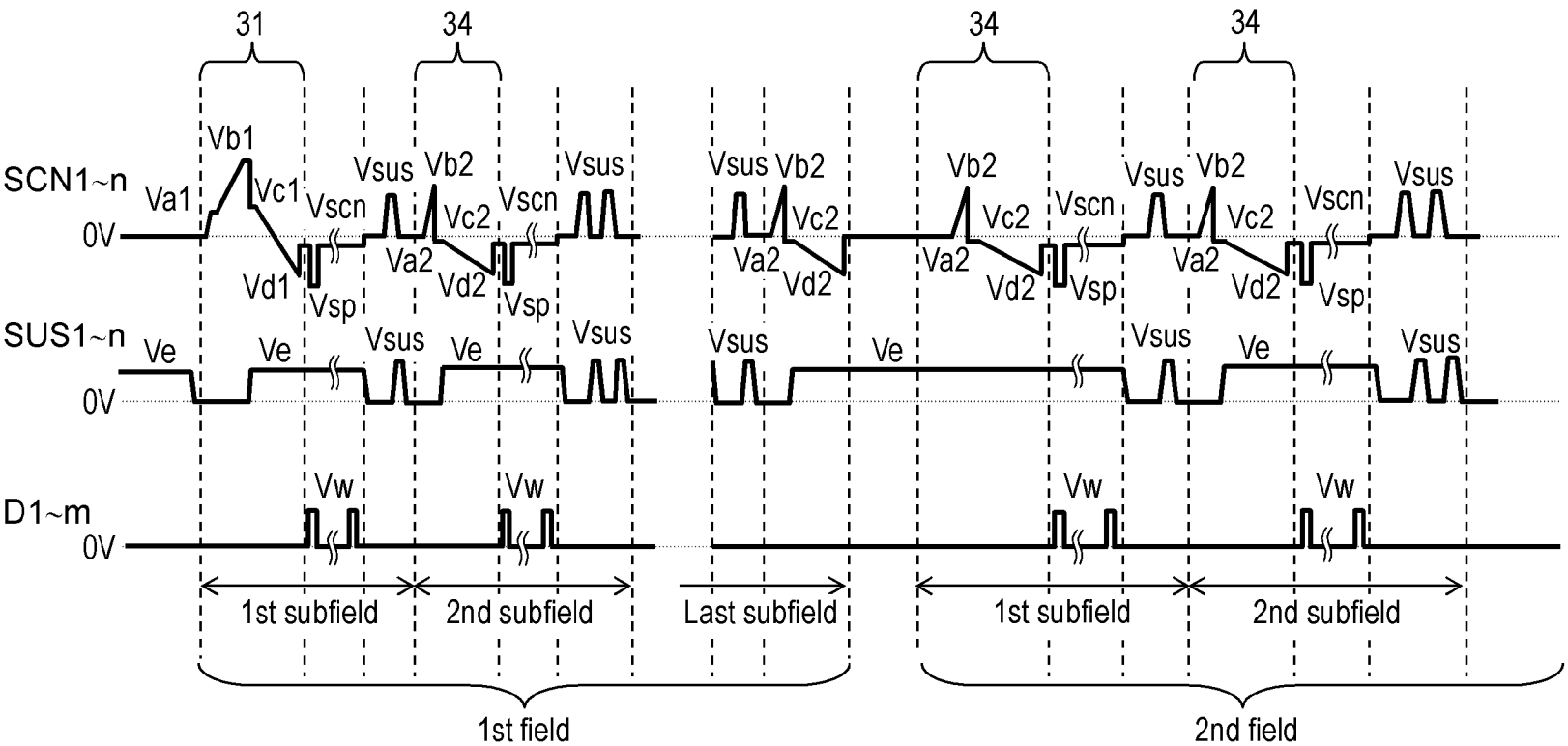
FIG. 21 is a timing chart of driving voltages applied to respective electrodes in accordance with a second example of the present invention.

The driving method in the second example of the present invention relates to a plasma display device in which, in at least one field among fields related to image display, initializing operations performed in the initializing periods of the respective subfields (SFs) are all selective initializing operations. FIG. 21 shows driving waveforms.

Hereinafter, a description is provided of validations of advantages conducted in the second example. The plasma display panels (PDPs) used in the validations are Prototype 5 and Prototype 6.

Figure 22:
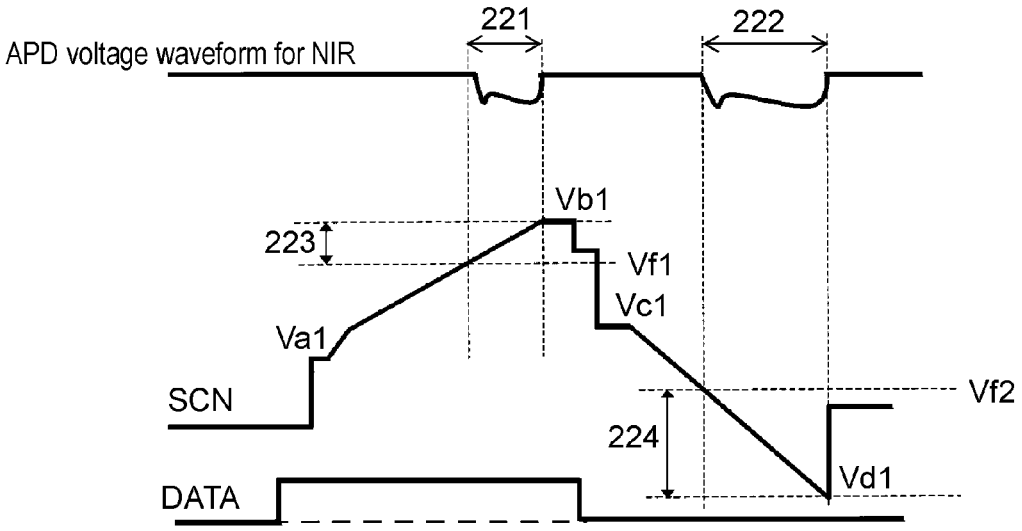
FIG. 22 is a diagram for explaining initializing pop voltages.

First, the luminance during black display is measured by using driving waveforms that are similar to those of FIG. 8 of the present invention but have different second voltage Vb1 in the all-cell initializing period. At this time, the total voltage related to the discharge in the first half of the initializing period and the second half of the initializing period are measured as an initializing pop voltage. Specifically, in the first half of the initializing period, a voltage between first voltage Va1 and second voltage Vb1 at which a discharge starts is set to Vf1. In the second half of the initializing period, a voltage between third voltage Vc1 and fourth voltage Vd1 at which a discharge starts is set to Vf2. Thus the initializing pop voltage is obtained by (Vb1−Vf1)+(Vf2−Vd1). FIG. 22 is a schematic diagram related to the measurement of the initializing pop voltage.

FIG. 22 shows a voltage waveform of a photodiode for near-infrared rays (APD voltage waveform for NIR in FIG. 22), a driving waveform of scan electrodes (SCN in FIG. 22), and a driving waveform of data electrodes (DATA in FIG. 22). In the drawing, the abscissa axis shows time. The voltage between voltage Vf1 and voltage Vb1 is up pop voltage 223, and the voltage between voltage Vd1 and voltage Vf2 is down pop voltage 224. In a period when the driving voltage applied to the scan electrodes is at up pop voltage 223, up light emission 221 is generated. In a period when the driving voltage applied to the scan electrodes is at down pop voltage 224, down light emission 222 is generated.

Figure 23:
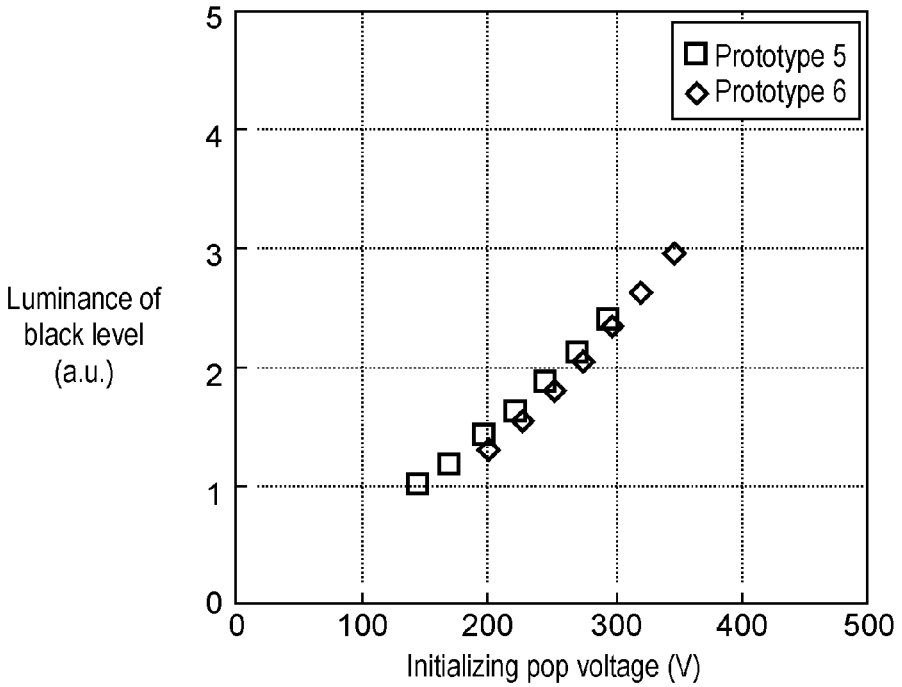
FIG. 23 is a characteristics diagram showing a relation between the initializing pop voltages and luminance of black level in experiments for validating an advantage of the plasma display device in accordance with the present invention.
Figure 24A:
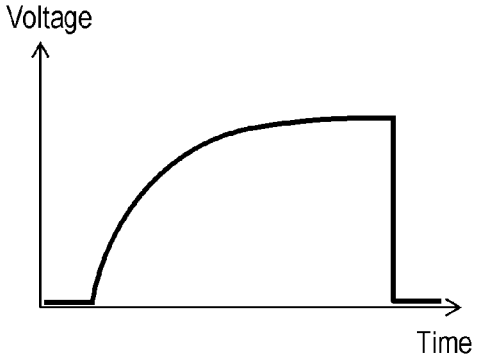
FIG. 24A is a diagram showing an example of a driving waveform applied to scan electrodes in a first half of an initializing period and a second half of the initializing period in accordance with a third example of the present invention.
Figure 24B:
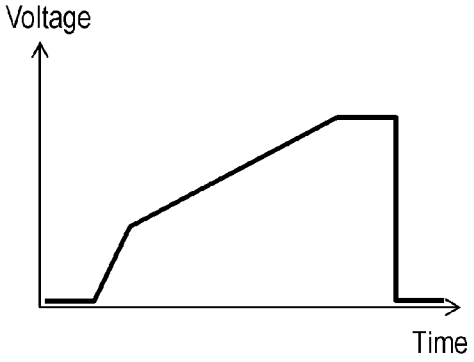
FIG. 24B is a diagram showing an example of the driving waveform applied to the scan electrodes in the first half of the initializing period and the second half of the initializing period in accordance with the third example.
Figure 24C:
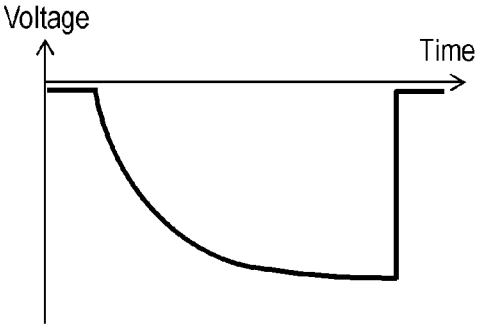
FIG. 24C is a diagram showing an example of the driving waveform applied to the scan electrodes in the first half of the initializing period and the second half of the initializing period in accordance with the third example.
Figure 24D:
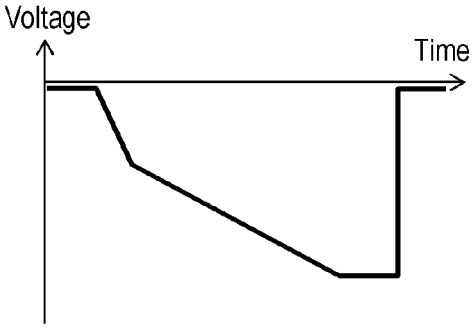
FIG. 24D is a diagram showing an example of the driving waveform applied to the scan electrodes in the first half of the initializing period and the second half of the initializing period in accordance with the third example.

In FIG. 23, the abscissa axis shows initializing pop voltages, the ordinate axis shows luminance during black display (hereinafter, luminance of black level), and the values in Prototype 5 and Prototype 6 are plotted. Herein, each of the slopes of the ramp voltage in the first half and second half of the initializing period is set to 2V/μsec, third voltage Vc1 is set to 210V, and the fourth voltage is set to 132V. According to the studies of the inventors, the relation between the voltage causing a weak discharge (initializing pop voltage) and the amount of light emission caused by the weak discharge is more conspicuously dependent on the discharge gas than the composition of protective layer 18 when the cell structures, e.g. the distance between electrodes and cell pitch, are identical. Prototype 5 and Prototype 6 have the identical cell structures and discharge gases, and protective layers 18 of different structures. Thus characteristics of luminance of black level have the same tendency.

When an address operation is performed on the cells in a field preceding the field, in the PDP of the present invention by the driving method of FIG. 9, the initializing pop voltage in an all-cell initializing operation in the field is higher than the initializing pop voltage in a selective initializing operation by (Vb1−Vb2) at the maximum. In the cells having undergone an address operation in a SF preceding the SF, wall charges more than those in the cells having undergone no address operation are accumulated. Thus an initializing operation (herein, a selective initializing operation) can be performed at second voltage Vb2, which is lower than second voltage Vb1 to be applied in the all-cell initializing operation.

However, when the charge retention capability is low, the accumulated wall charges are gradually lost in a standby period from the completion of the address operation to the selective initializing operation, and thus the selective initializing operation cannot be performed normally.

For example, for each of Prototype 2 and Prototype 5, when continuous display raises the panel temperature, the charge retention capability is degraded and lowest scan voltage Vscn necessary for the address operation is rapidly increased. For Prototype 3, lowest scan voltage Vscn largely exceeds a reference value of 120V irrespective of panel temperature. In contrast, for each of Prototype 4 and Prototype 6, lowest scan voltage Vscn is not increased and is lower than the reference value of 120V irrespective of panel temperature.

When the driving method of the present invention shown in FIG. 21 is performed on Prototype 2, Prototype 3, and Prototype 5, a selective address operation cannot be performed on some cells having insufficient wall charges, and images cannot be displayed normally. In contrast, when the driving method of the present invention shown in FIG. 21 is performed on Prototype 4 and Prototype 6, a strong discharge in the initializing operation is suppressed and a selective address operation can be performed.

For a conventional PDP having a low charge retention capability, at least one all-cell initializing operation having a high crest value needs to be performed in each field so that the initializing operation allows accumulation of wall charges desired for the address operation. Because the PDP of the present invention has a stably high charge retention capability irrespective of panel temperature, an all-cell initializing operation does not need to be performed in each field.

For the PDP of the present invention driven by the driving method of FIG. 8, as described above, an excess voltage of (Vb1−Vb2) at the maximum is applied to the cells having undergone an address operation, in the all-cell initializing operation. When an all-cell initializing operation is performed on the cells having undergone an address operation by the driving method of FIG. 8 where Vb1−Vb2=100V, for example, the luminance of black level is increased by 89% at the maximum. In the PDP of the present invention that has a high charge retention capability, the number of all-cell initializing operations can be reduced as shown in FIG. 21 and thus the luminance of black level is reduced. Thus a plasma display device having high expressive power of black color can be provided.

THIRD EXAMPLE

Figure 25:
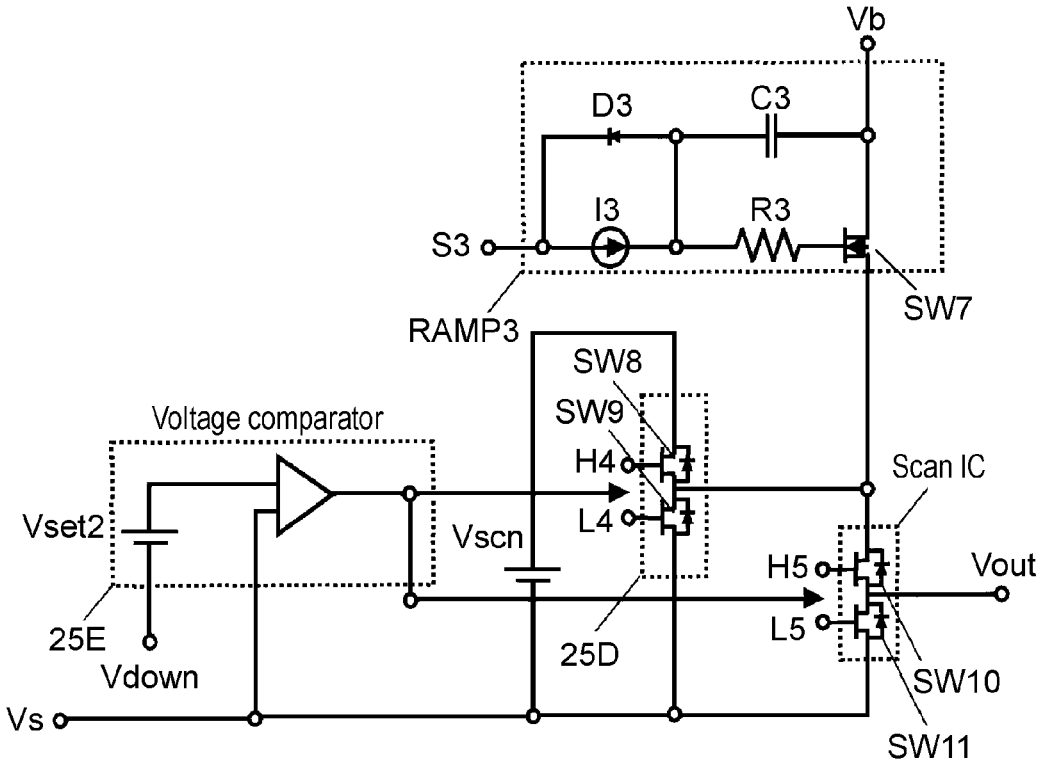
FIG. 25 is a diagram showing an example of a scan electrode driving circuit for outputting the driving waveforms in accordance with the third example.

The driving method in the third example of the present invention relates to a plasma display device in which the slope of a ramp voltage is changed. FIG. 25 shows an example of a driving circuit in accordance with the third example. FIG. 24A through FIG. 24D show operating waveforms. In each of FIG. 24A through FIG. 24D, the abscissa axis shows time, and the ordinate axis shows voltages.

As shown in FIG. 25, the driving circuit of the third example is configured so that power supply voltage Vic of scan integrated circuit (IC) is used for one of gradually rising ramp voltages. The driving circuit is composed of the following four elements: ramp generating circuit RAMP3, the scan IC, scan voltage selecting circuit 25D, and scan potential raising circuit 25E. Ramp generating circuit RAMP3 is composed of constant current circuit I3, capacitor C3, diode D3, resistor R3, switch SW7, and power supply voltage Vb. The scan IC is composed of series-connected high-side switch SW10 and low-side switch SW11. Scan voltage selecting circuit 25D is formed by connecting switch SW8 in series with switch SW9 across power supply voltage Vscn for address operation. Scan potential raising circuit 25E includes a voltage comparator. The output terminal of ramp generating circuit RAMP3 and the midpoint of scan voltage selecting circuit 25D are connected to the power supply input terminal of the scan IC. The negative electrode of power supply Vscn and the other end of switch SW9 are connected to GND of the scan IC and to power supply Vs. A voltage is output to scan electrode 19*a* from the midpoint of the scan IC. One scan IC is connected to one scan electrode 19*a*, and the scan ICs are disposed parallel to each other. Scan voltage selecting circuit 25D is a circuit for controlling switching on/off the scan pulses in address periods.

Hereinafter, the operation of the driving circuit in an initializing period is described. First, only low-side switch SW11 of each scan IC is tuned on (via a diode, properly describing), and voltage Vs is applied to scan electrodes 19*a*. Voltage Vs is 0 V. Next, as signal S3, a HIGH is input, and power supply voltage Vb for generating a ramp voltage is applied to the scan ICs via switch SW7. However, switch SW8, switch SW9, and switch SW10 are off, and thus power supply voltage Vb is not output to scan electrodes 19*a*. Meanwhile, main voltage Vs is sharply increased from 0 V to Va and is applied to scan electrodes 19*a*.

Next, in each scan IC, low-side switch SW11 is turned off and high-side switch SW10 is turned on. At this time, the charge current from constant-current circuit 13 charges the parasitic capacitance of switch SW9 and switch SW10. Thus, until the voltage to be applied to the scan ICs has been charged to an operation starting voltage, high-side switch SW10 is not turned on, and the voltage applied to scan electrodes 19*a* is kept at Va. When the voltage of each scan IC exceeds the operation starting voltage, switch SW10 starts to be turned on. The charge current makes the voltage applied to scan ICs a ramp voltage, which rises from voltage Va to voltage (Va+Vic).

After a voltage of Vic or higher has been applied to the scan ICs to completely turn on switch SW10, ramp voltage generation circuit RAMP3 causes a ramp voltage to be output until the ramp voltage reaches voltage Vb.

After the ramp voltage has reached power supply voltage Vb, signal S3 is switched off, and switch SW8 is turned on. Thus the voltage to be applied to scan electrodes 19*a* via switches SW8 and SW10 falls to voltage (Va+Vscn). Next, switch SW9 and switch SW11 are turned on. Thus the voltage of the scan ICs becomes 0V and the voltage applied to scan electrodes 19*a* falls to voltage Va.

With the above circuit configuration, two periods in which the ramp voltages have different slopes are set. A voltage waveform can be generated so that the slope of the latter ramp voltage is gentler than the slope of the former ramp voltage. The circuit configuration shown in FIG. 25 is an example for outputting the ramp voltages having two different slopes. The present invention is not limited to this configuration.

In the third example, in the first half of the initializing period, the ramp voltage is set to have a slope gradually becoming gentle. How a discharge spreads in an initializing operation is observed from the front side of the panel, using a high-sensitivity CCD camera while the opening and closing operation of the shutter is controlled by a gate signal generator. The observation shows the following results. As first voltage Va changes to second voltage Vb in the initializing operation caused by the ramp voltage, a discharge proceeds from the inside (the side nearer to the center of a discharge cell) to the outside (the sides nearer to the barrier ribs of the discharge cell) of each transparent electrode, between negative electrodes, i.e. sustain electrode 19*b* and address electrode 14, and a positive electrode, i.e. scan electrode 19*a*.

The PDP of the present invention has excellent electron emission characteristics and is capable of inhibiting a strong discharge in the initializing operation. However, when the discharge spreads outside, excessive electrification is generated in the phosphors on the barrier ribs and in the vicinity thereof. The electrification can cause an abnormal address operation after the initializing operation, and images cannot be displayed normally in some cases. To address this problem, a ramp voltage is set to have a slope gradually becoming gentler. Thereby, the discharge is weakened in a time period in which the discharge spreads outside, and the excessive electrification on the side walls can be reduced. Further, the first half of the initializing period has a sub-period in which the voltage of address electrodes 14 is set to a positive value. Thereby, the discharge spread can be inhibited and the excessive electrification on the side walls can be reduced.

Further, the slope of the ramp voltage is set steeper in the time period at the beginning. Thereby, the time taken for the initializing operation can be reduced. Thus more time can be spared for the address operation related to stability of image display and the sustain operation related to the brightness of images.

As described above, in the plasma display device in which the PDP of the present invention is driven by the driving method of the present invention, it is preferable to set the slope of the ramp voltage to 20 V/μsec or gentler. This value is set also in consideration of long-term reliability of protective layer 18, i.e. an electron emission source, variations in producing the PDPs and driving circuits, image quality degraded by occurrence of a strong discharge in an initializing operation, and excessive electrification on the side walls.

FOURTH EXAMPLE

The driving method in the fourth example of the present invention relates to a plasma display device in which scan potential raising circuit 25E is eliminated from the circuit configuration of FIG. 25 and the potential of a scan pulse applied to scan electrodes 19*a* is equal to fourth voltage Vd. The PDP of the present invention has a stable charge retention capability and little loss of the wall charges in a standby period of the address operation. Thus voltage Vset2 added to compensate for the voltage corresponding to the lost electric charges can be omitted in some cases. In such cases, scan potential raising circuit 25E can be eliminated, and thus a plasma display device can be provided at lower cost.

The above descriptions have been provided for an exemplary embodiment of the present invention. The present invention is not limited to a case where dielectric layer 17 is in contact with each electrode. The dielectric layer may be disposed in the periphery of each electrode. Agglomerated particle groups 18*c* may be disposed on the surface or the inside of protective layer 17. In such a case, the same advantages can be offered. The cell configuration of the PDP is not limited to a surface discharge type as shown in FIG. 1. In an opposed discharge PDP having opposed electrodes formed therein, the same advantages can be offered.

The present invention includes the following cases where: before the first half of the initializing period, the voltage of the third electrode rises to a positive value; in the middle of the first half of the initializing period, the voltage falls from a positive value; and a period in which the voltage has a positive value appears at a plurality of times.

As obvious from the above descriptions, the plasma display device of the present invention has advantages of increasing the density of charged particles or excitation particles (hereinafter, priming particles) present in the discharge part at the initial stage, and inhibiting a strong discharge that considerably degrades the contrast ratio, in initializing periods prior to address periods.

Further, the plasma display device has advantages of reducing the influences of electric field interference between the adjacent cells and scattering charged particles in selective initializing periods, and thus inhibiting degradation of image quality caused by failure in selecting lit or unlit cells in address periods.

Further, even when the number of scan lines is increased by an increase in definition, addressing failure caused by discharge delay can be inhibited for high-speed address operation. Thus the image quality can be enhanced by increased definition.

Further, charge decreasing in a standby period after the completion of an initializing operation before an address operation can be prevented. Therefore, the scan voltage and address voltage applied in address periods, and thus the number of components in the scan ICs and address electrode driving circuit can be reduced. As a result, a PDP can be provided at lower cost.

Further, with the advantage of inhibiting a strong discharge in initializing periods, the advantage of preventing discharge decreasing, and the advantage of inhibiting discharge delay, the mixing ratio of a gas having a large atomic number, e.g. xenon and krypton, and the total pressure of a discharge gas can be increased. Thus a plasma display device having higher luminance and efficiency, and saving power can be provided.

The present invention addresses problems of a conventional PDP and driving method at the same time. Flickers and roughness of images are dramatically improved. Further, the number of components in the address electrode driving circuit can be reduced, and the cost of scan ICs can be reduced by a decreased voltage of scan pulses. Thus a plasma display device having high definition and saving power can be provided at low cost.

Industrial Applicability

The plasma display device of the present invention includes a plasma display panel. The plasma display panel has a plurality of agglomerated particle groups in which a plurality of crystal particles made of metal oxide agglomerate, in the periphery of protective layer 18. In the driving method of the plasma display panel, an initializing period has a first half of the initializing period in which second electrodes are applied with a voltage gradually rising from a first voltage to a second voltage, and a second half of the initializing period in which the second electrodes are applied with a voltage gradually falling from a third voltage to a fourth voltage. This driving method makes the plasma display panel useful as an image display device for displaying images of excellent quality. The present invention can be used for an image display device formed of a plasma display or a full-specification high-definition plasma display whose efficiency is enhanced by a high Xe partial pressure or a high total pressure.

The invention claimed is:

1. A plasma display device comprising:

a plasma display panel including:

a first substrate including (i) a pair of electrodes including a first electrode and a second electrode, (ii) a dielectric layer formed so as to cover the first electrode and the second electrode, and (iii) a protective layer formed on a surface of the dielectric layer; and a second substrate including (i) a third electrode, and (ii) a dielectric layer formed so as to cover the third electrode, wherein the first substrate and the second substrate are positioned so as to face each other, wherein a discharge gas is sealed between the first substrate and the second substrate, wherein the protective layer includes:

a base protective layer formed of a thin film containing a metal oxide; and a particle layer formed by discretely sticking, to the base protective layer, agglomerated particles in which a plurality of single-crystal particles of magnesium oxide are aggregated by static electricity between the plurality of single-crystal particles of magnesium oxide and are distributed across the entire surface of the base protective layer, wherein one field is formed of a plurality of subfields, wherein each of the subfields has an initializing period, an address period, and a sustain period, and wherein the initializing period has a first half of the initializing period in which the second electrode is applied with a voltage gradually rising from a first voltage to a second voltage, and a second half of the initializing period in which the second electrode is applied with a voltage gradually falling from a third voltage to a fourth voltage.

2. The plasma display device of claim 1, wherein a particle diameter of the single-crystal particles of magnesium oxide ranges from 0.9 micrometer (μm) to 2 micrometers (μm) inclusive.

3. The plasma display device of claim 1, wherein the base protective layer is made of magnesium oxide (MgO).

4. The plasma display device of claim 1, wherein, in the one field, initializing operations performed in the initializing period are all selective initializing operations.

5. The plasma display device of claim 1, wherein the first half of the initializing period has two periods in which a slope of the rising voltage is different, and wherein the slope in a later one of the two periods is gentler than the slope in an earlier one of the two periods.

6. The plasma display device of claim 1, wherein the second half of the initializing period has two periods in which a slope of the falling voltage is different, and wherein the slope in a later one of the two periods is gentler than the slope in a earlier one of the two periods.

7. The plasma display device of claim 1, wherein a voltage of a scan pulse applied to the second electrode in the address period is at an identical potential with the fourth voltage.

8. The plasma display device of claim 1, wherein the first half of the initializing period has a period in which a voltage of the third electrode has a positive value.

9. The plasma display device of claim 1, wherein a slope of the voltage rising in the first half of the initializing period is equal to or lower than 20 V/μsec.

10. The plasma display device of claim 1, wherein a slope of the voltage falling in the second half of the initializing period is equal to or lower than 20 V/μsec.

11. The plasma display device of claim 1, wherein a cycle of a scan pulse applied to the second electrode in the address period ranges from 0.5 μsec to 1.8 μsec inclusive.

12. The plasma display device of claim 2, wherein the base protective layer is made of magnesium oxide (MgO).

* * * * *